United States Patent [19]

Focke et al.

[11] Patent Number: 4,718,216

[45] Date of Patent: Jan. 12, 1988

[54] PROCESS AND APPARATUS FOR PACKAGING CIGARETTES IN PARTICULAR

[75] Inventors: Heinz Focke; Kurt Liedtke, both of Verden, Fed. Rep. of Germany

[73] Assignee: Focke & Co., Verden, Fed. Rep. of Germany

[21] Appl. No.: 846,536

[22] Filed: Mar. 31, 1986

[30] Foreign Application Priority Data

Apr. 6, 1985 [DE] Fed. Rep. of Germany ..... 3512611

[51] Int. Cl.[4] ..... B65B 11/28

[52] U.S. Cl. ..... 53/444; 53/151; 53/234; 53/202; 53/148

[58] Field of Search ..... 53/148, 151, 234, 202, 53/444, 464

[56] References Cited

U.S. PATENT DOCUMENTS

| | | | |
|---|---|---|---|
| 2,972,217 | 2/1961 | Ashby | 53/234 |
| 3,590,556 | 7/1971 | Focke | 53/234 |
| 4,265,073 | 5/1981 | Seragnoli | 53/234 X |
| 4,428,177 | 1/1984 | Focke | 53/234 X |
| 4,584,816 | 4/1986 | Mattei | 53/234 X |

*Primary Examiner*—John Sipos

*Attorney, Agent, or Firm*—Sughrue, Mion, Zinn, Macpeak and Seas

[57] ABSTRACT

Packaging machines have to, on the one hand, achieve high levels of output but, on the other hand, take into account the sensitivity of the cigarettes to mechanical stresses. A two-track configuration of the packaging machine doubles the output at a given speed (number of strokes). By the special designing of a cigarette magazine (26) in conjunction with a group turret (28), it is accomplished that the formation of cigarette groups (21) and the insertion into the pockets (64) of the group turret (28) can be performed within adequately set stroke times at a high output of the packaging machine.

45 Claims, 16 Drawing Figures

PROCESS AND APPARATUS FOR PACKAGING CIGARETTES IN PARTICULAR

DESCRIPTION

Figure 1:
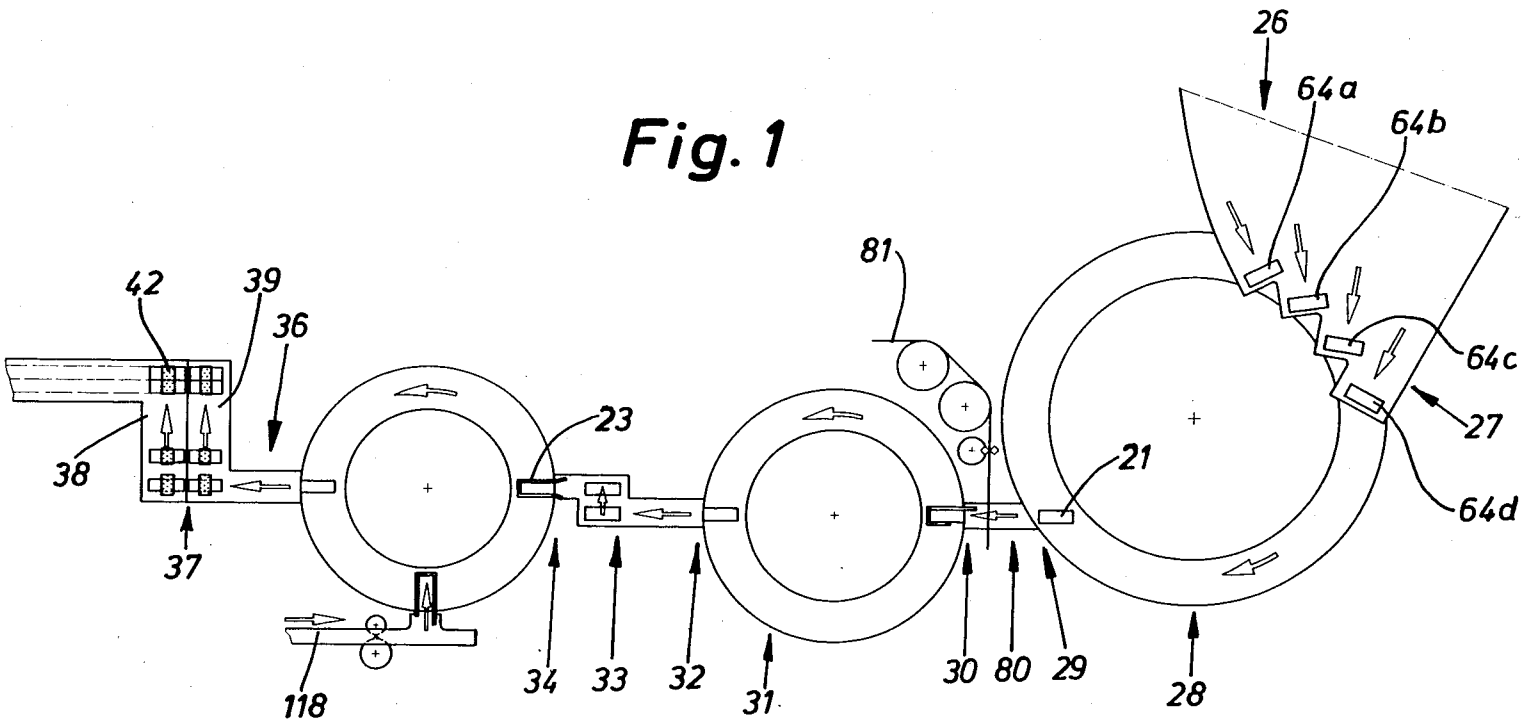

The invention relates to a process for packaging articles, particularly cigarettes, by combining them into groups (cigarette groups) and wrapping them in at least one blank of packaging material (tin-foil sheet, paper or the like), and in this process the group, taking with it the blank provided in a plane transverse relative to the conveying direction of the group, is introduced into a pack receptacle (pocket) of a (first) folding conveyor (folding turret) and, when conveyed further, is folded. The invention also relates to an apparatus for carrying out the process.

The subject of the invention is a packaging machine, particularly for cigarettes, to produce so-called soft-cup packs, with an inner blank consisting of tin-foil, which completely surrounds the cigarette group to form a tin-foil block, and with a cup-shaped outer wrapper consisting of a paper blank. This is open at the top, so that the tin-foil block projects slightly from the softcup pack.

Packs of this type are produced on high-performance packaging machines. Most of these contain rotating folding turrets for the successive folding of the blanks. Because the folding turrets are driven intermittently (i.e. indexed), the productive capacity of the packaging machine is limited.

The object on which the invention is based is to provide a packaging machine with intermittently driven (i.e. indexed) folding conveyors (folding turrets), in which the output is nevertheless increased considerably, without this requiring undesirably high indexing speeds for the individual folding conveyors.

To achieve this object, in the process according to the invention, to be used on packaging machines, the folding conveyor (folding turret) is preceded by a group conveyor (group turret) which conveys the articles (cigarette groups) into group receptacles (pockets), the articles being pushed into the pockets in the axial direction and pushed out of these in the axially transverse direction.

When the cigarette groups are pushed out of the group turret, thereby taking up the provided blank in the form of a U, the sensitive end faces of the cigarettes are not subjected to any load. On the contrary, because the cigarette groups are conveyed by being pushed out axially transversely, the blank can wrap itself round the less sensitive longitudinal side of the cigarette group. To make it possible to push in the cigarettes in the axial direction and push them out axially transversely, the pockets of the group turret are open at least on an axially directed side and on the side located on the outside in the axially transverse direction. During filling and during subsequent transport, the cigarettes are limited, guided or retained here.

In the region of an ejection station, the formed cigarette groups are ejected from the group turret in a horizontal plane at a distance below the horizontal midplane of the latter and, at the same time taking up a transversely directed blank, are pushed into the pocket of a first folding turret. In the region of the latter, parts of the blank are folded; during ejection or in the region of an adjoining folding track, further parts of the blank are folded.

According to an alternative embodiment of the apparatus and of the process, tin-foil blocks prefabricated at another time are supplied along two tracks to a block turret which is comparable in terms of design and function to the group turret and which each time receives two tin-foil blocks in the axial direction, next to one another. The tin-foil blocks are delivered to the pockets of this block turret by special transfer turrets of differing size, which are arranged in such a way that, each time, two tin-foil blocks are introduced into a pocket in succession.

Figure 2:
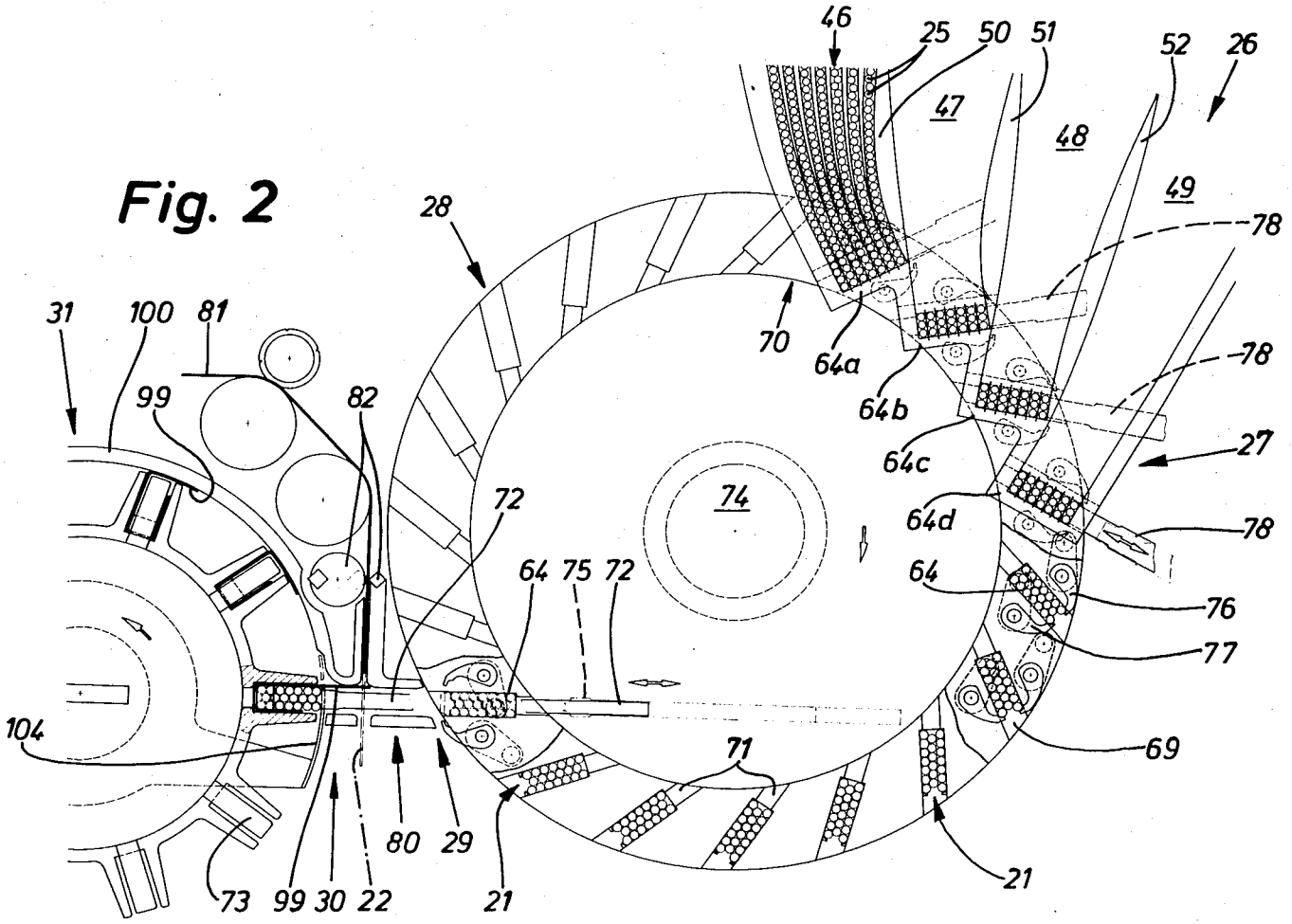
Figure 3:
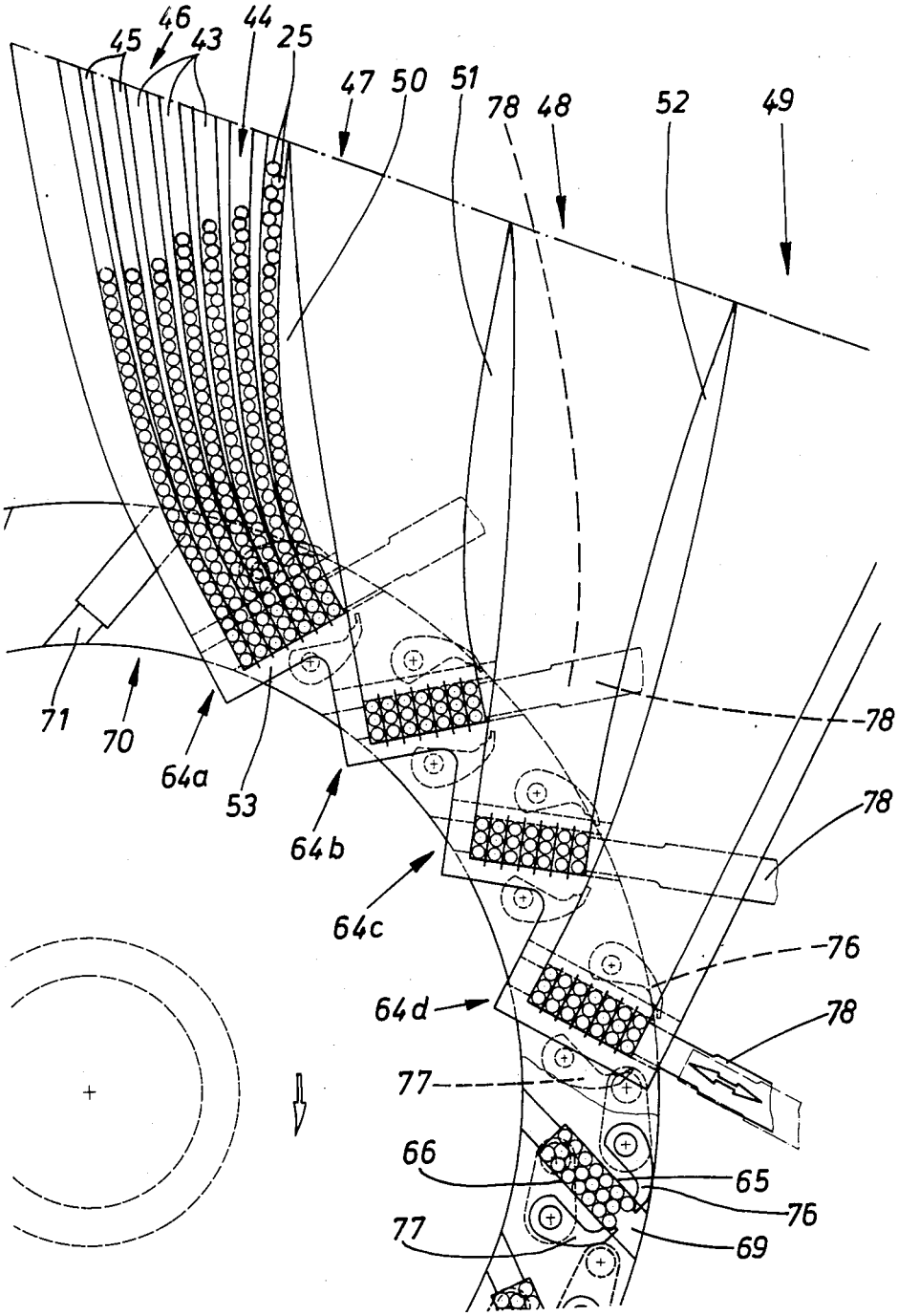
Figure 4:
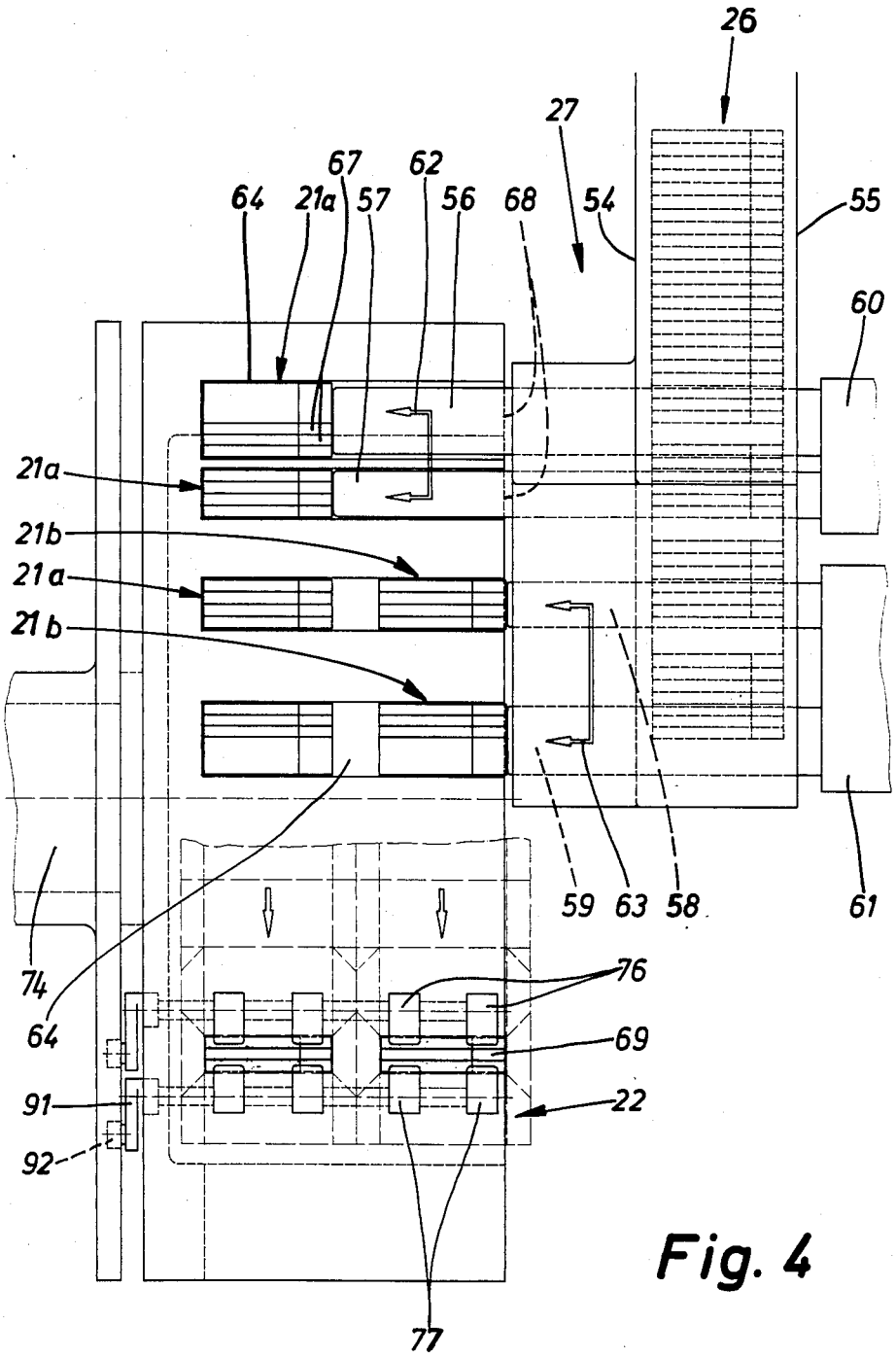
Figure 5:
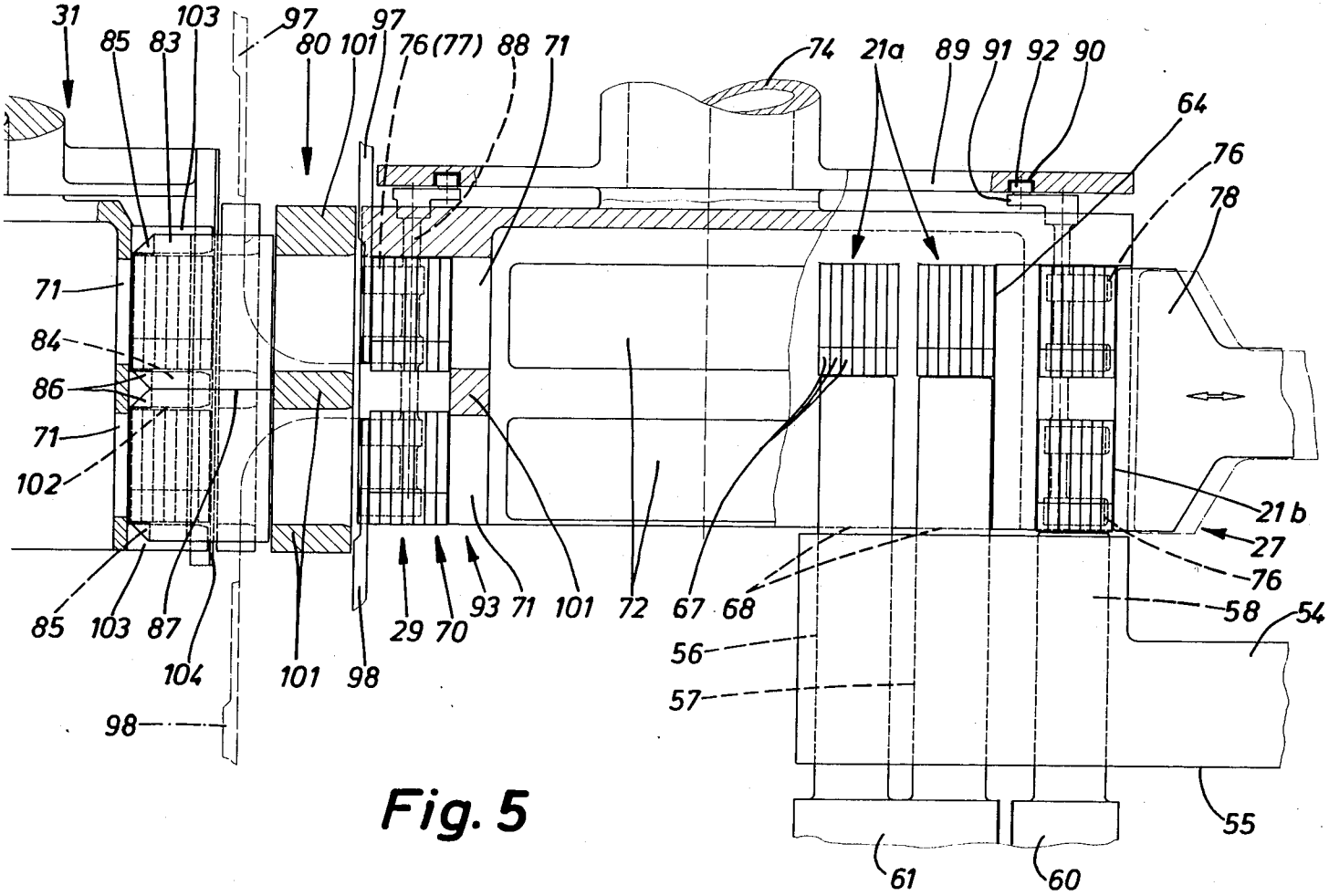
Figure 6:
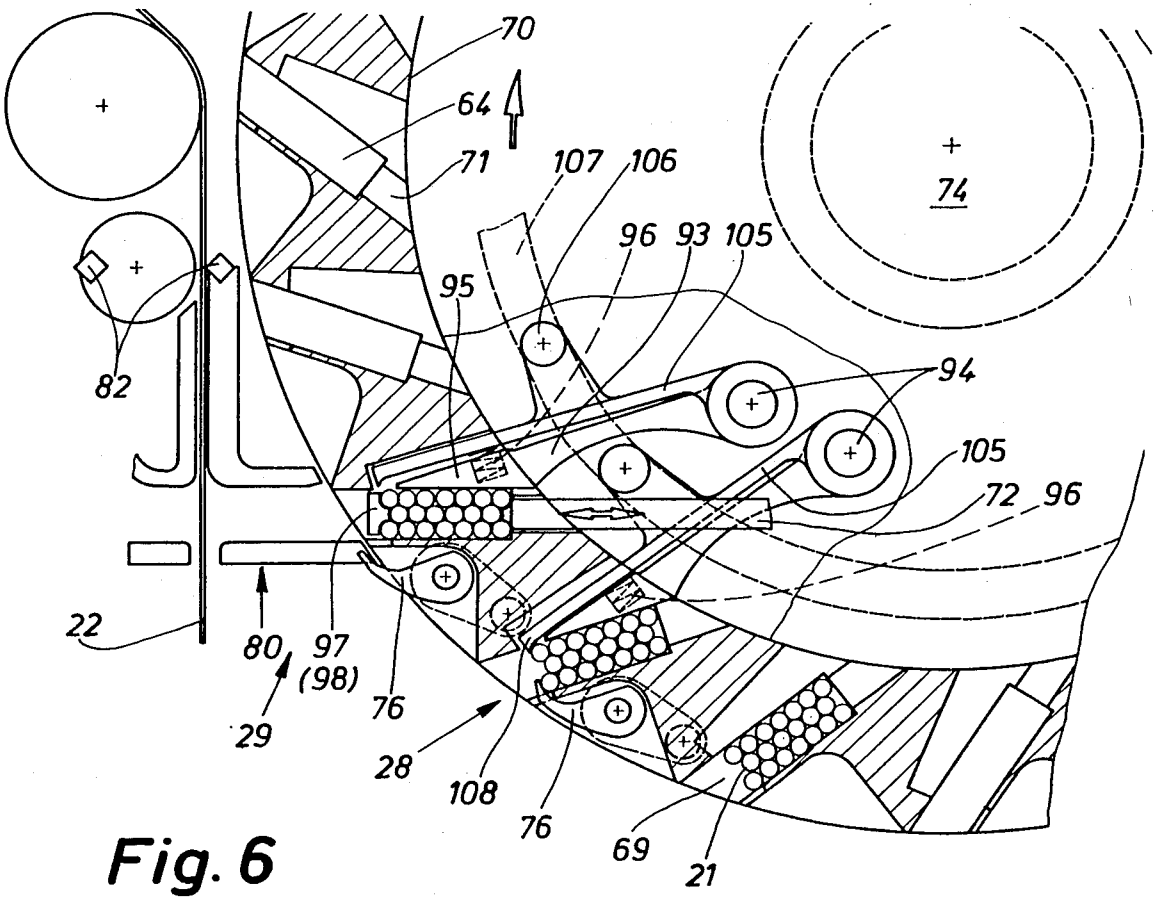
Figure 7:
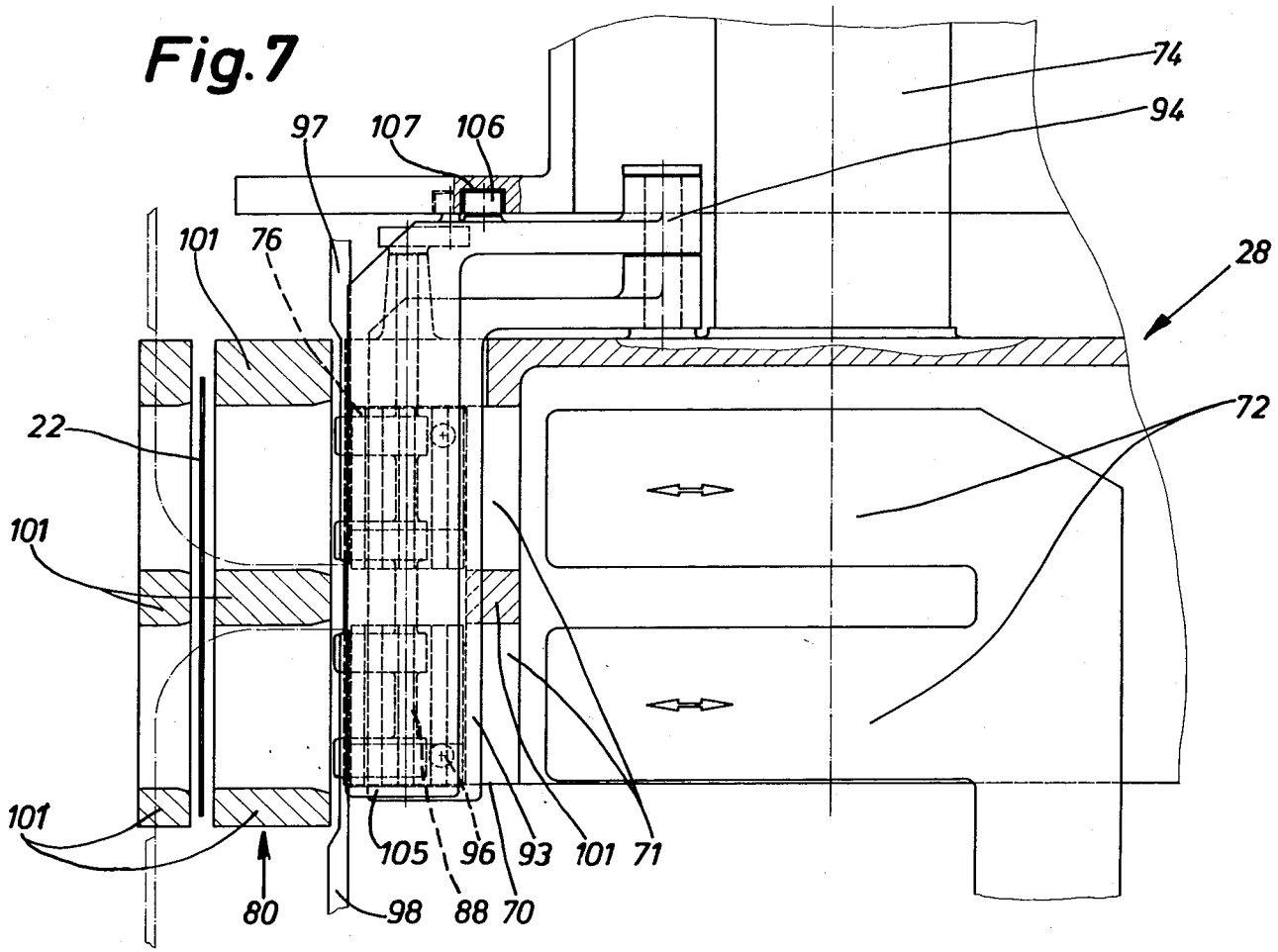
Figure 8:
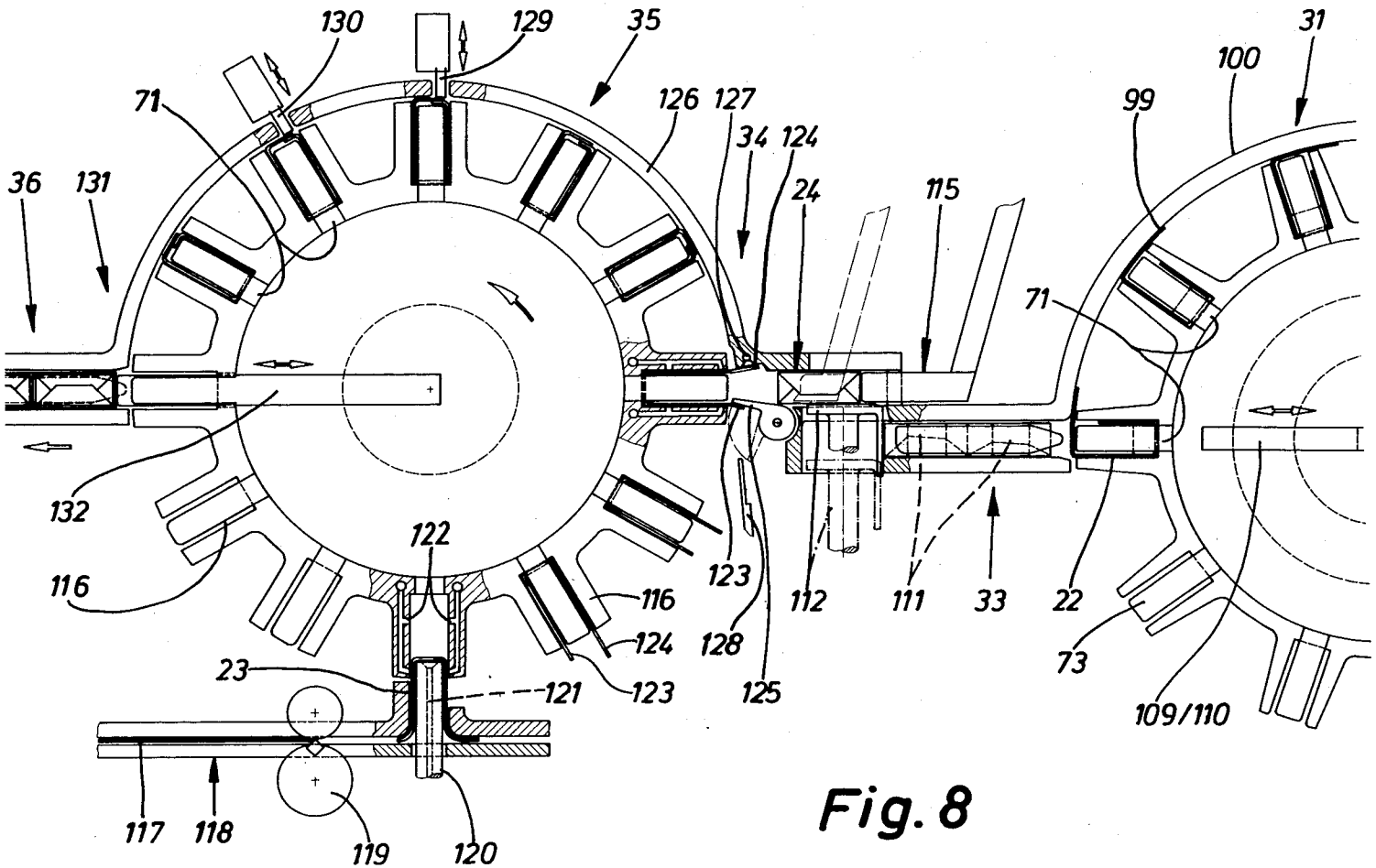
Figure 9:
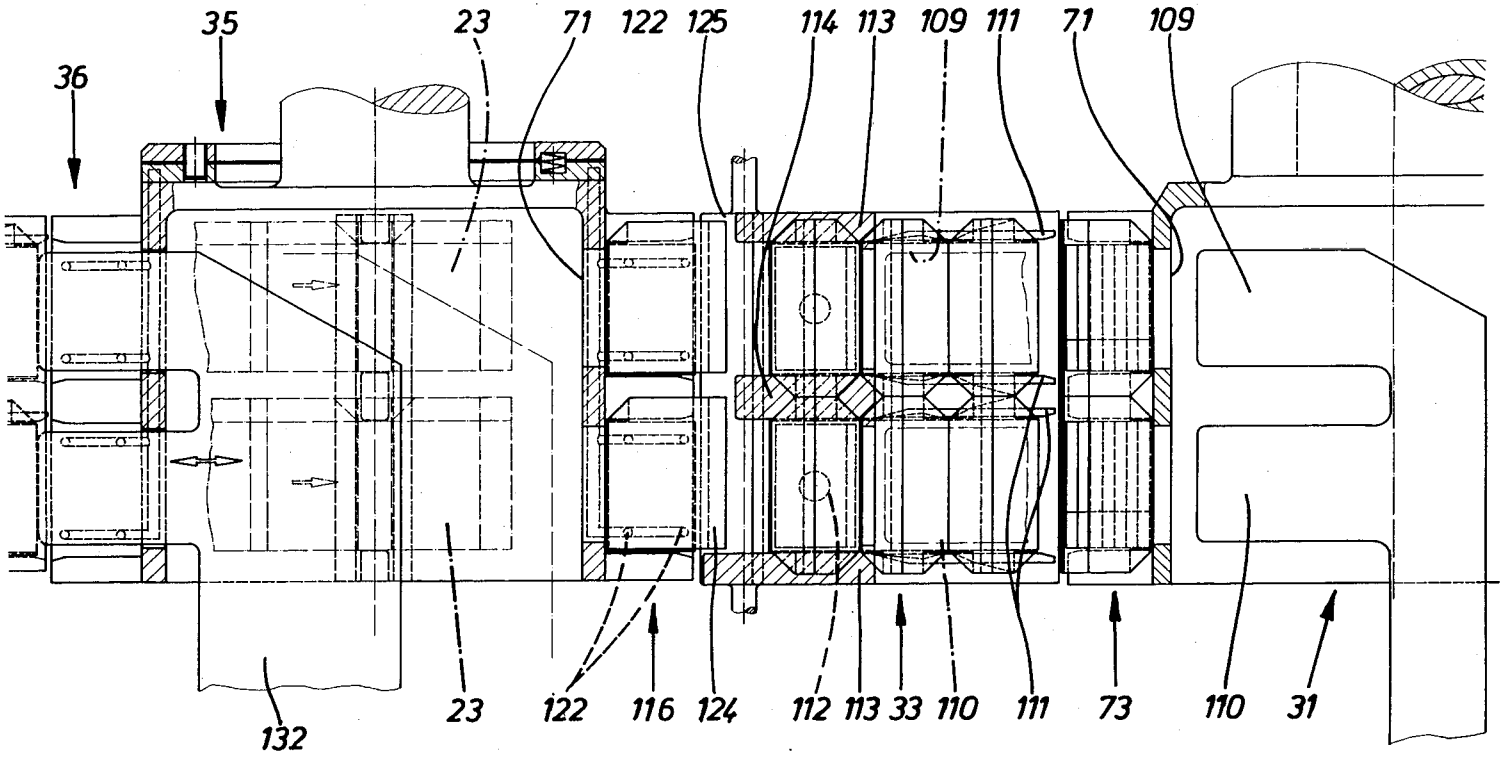
Figure 10:
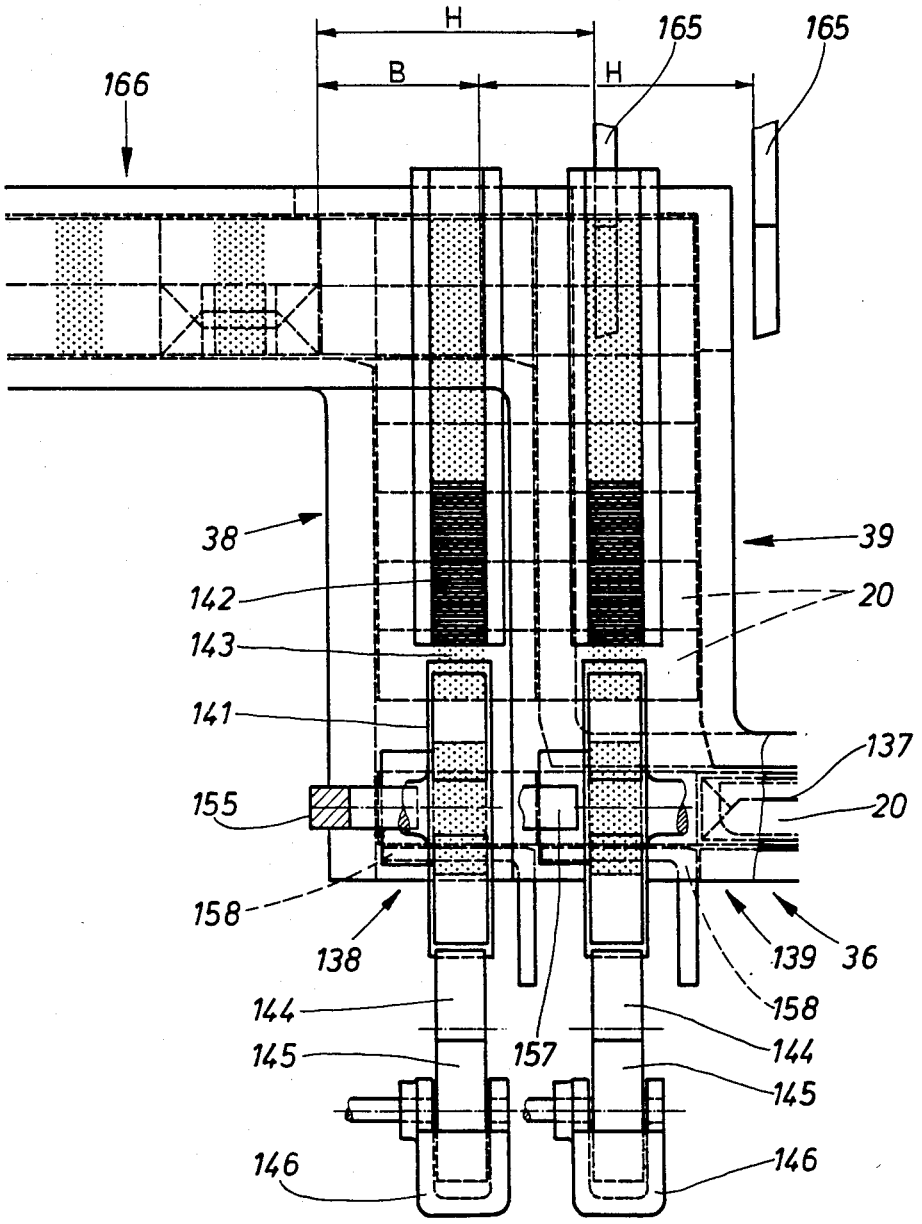
Figure 11:
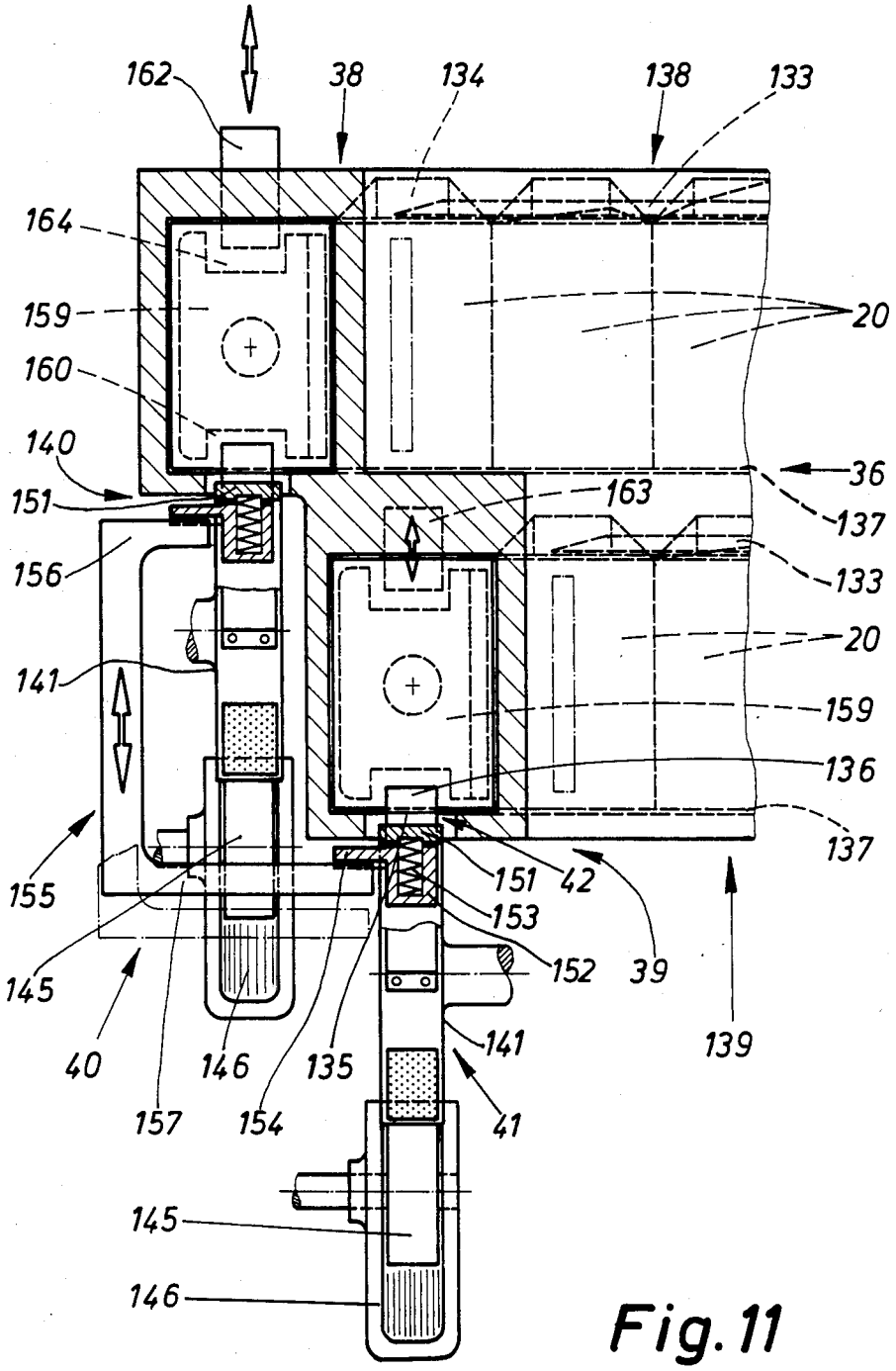
Figure 12:
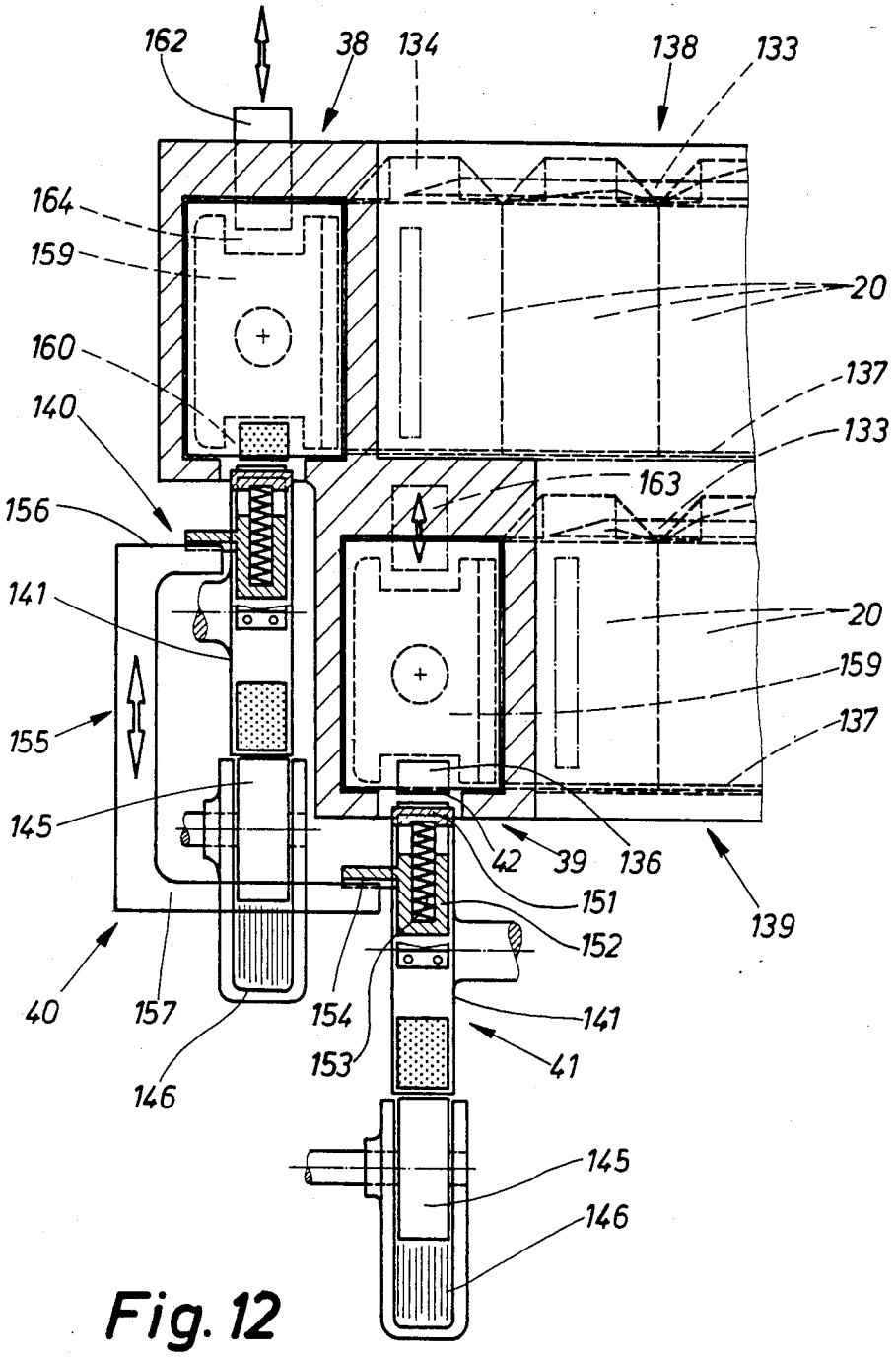
Figure 13:
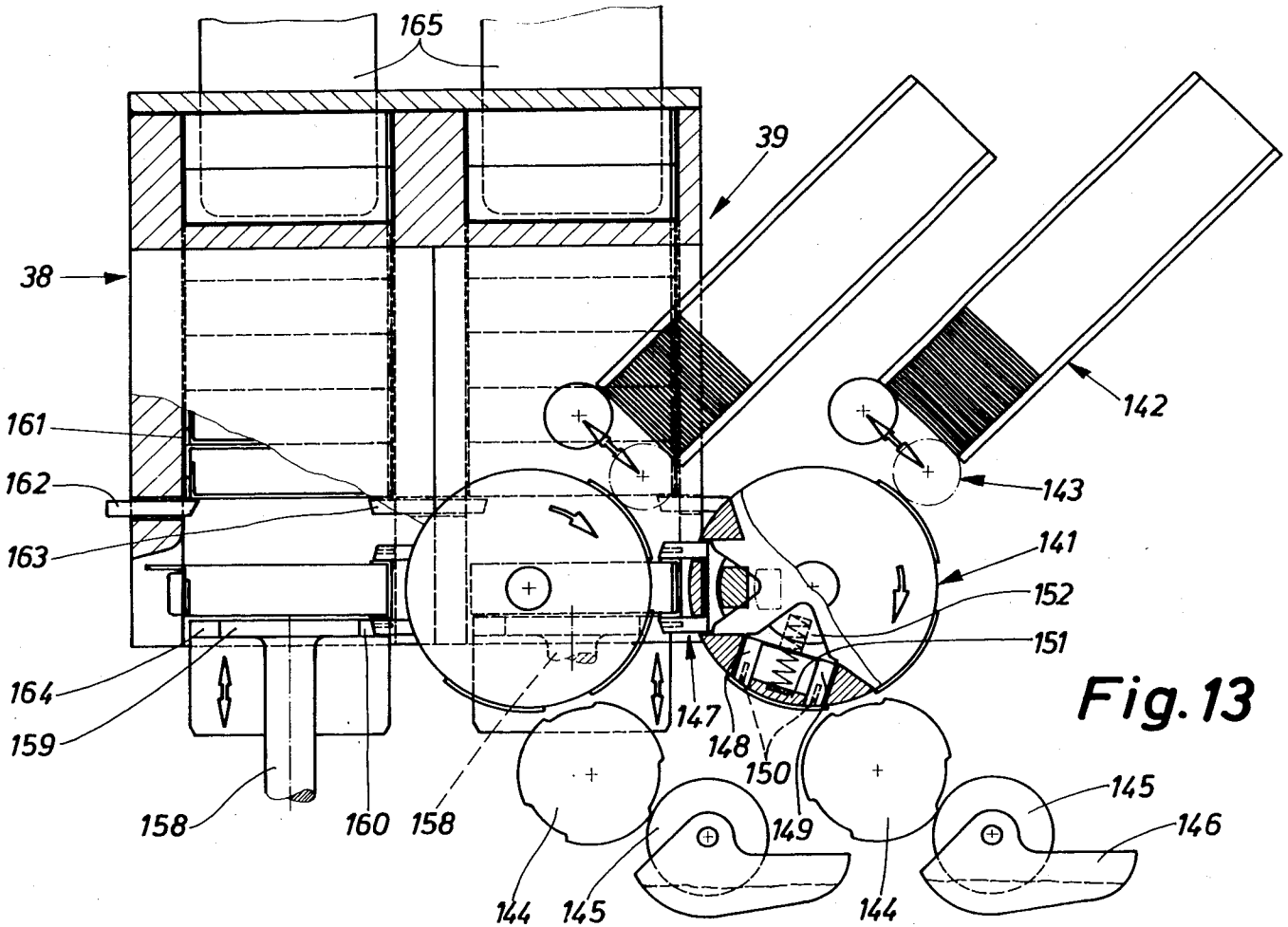
Figure 14:
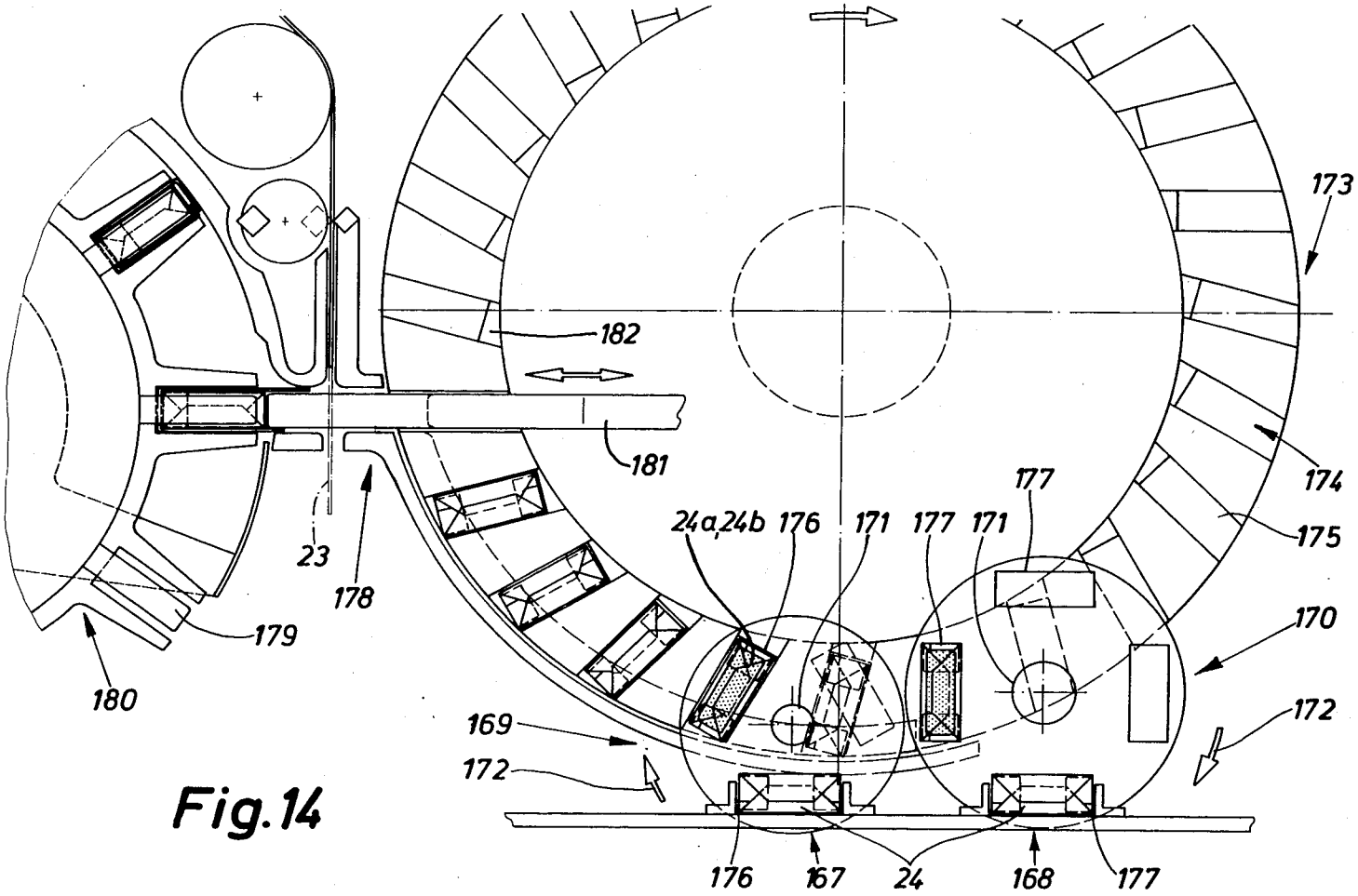
Figure 15:
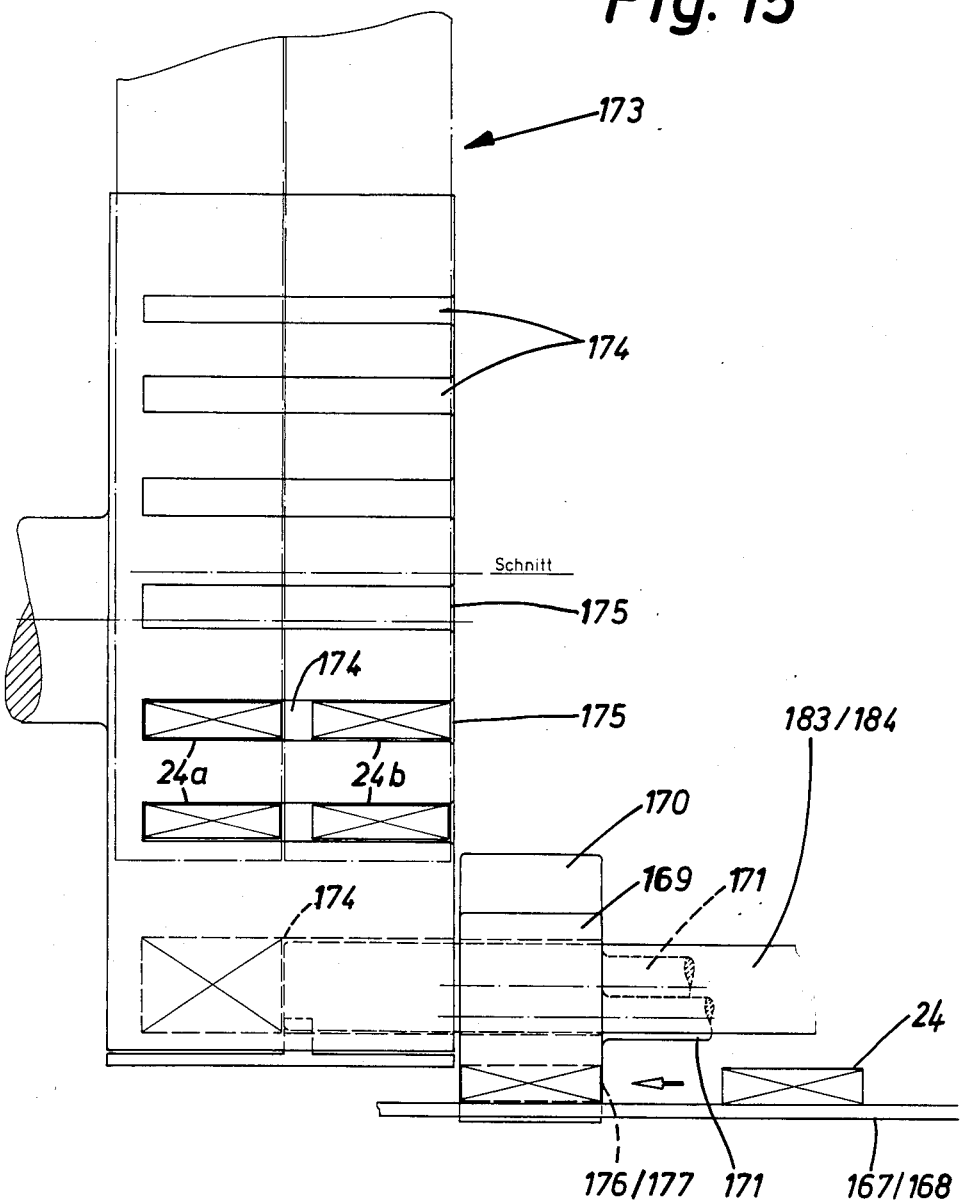
Figure 16:
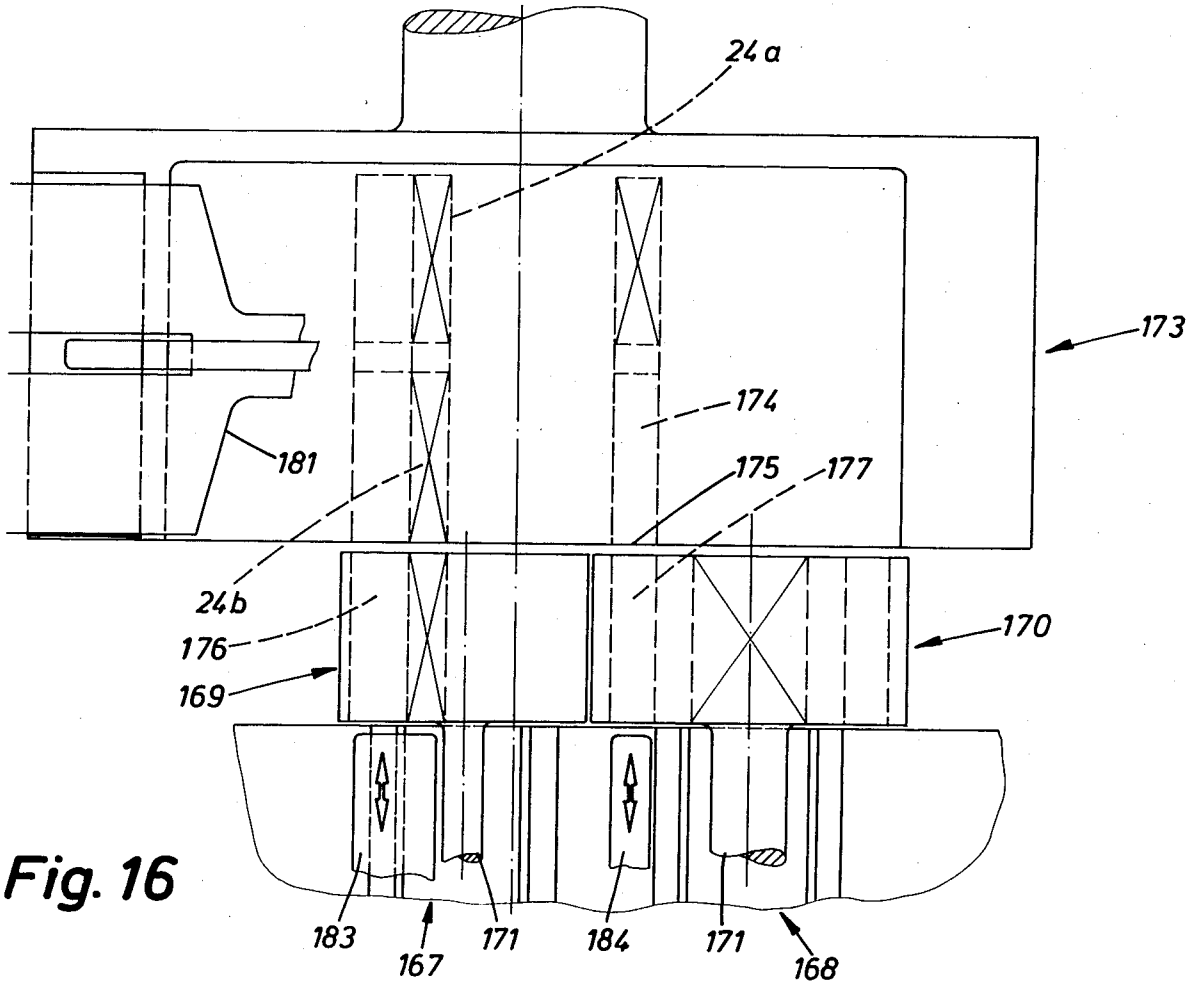

Further features of the invention are contained in the sub-claims. Exemplary embodiments of the apparatus according to the invention are explained in detail with reference to the drawings. In the drawings:

FIG. 1 shows a diagrammatic side view of the apparatus as a whole,

FIG. 2 shows a detail, in particular a group turret, in a side view, on an enlarged scale, FIG. 3 shows a detail of the group turret with a cigarette magazine, on a further-enlarged scale, FIG. 4 shows the group turret with the cigarette magazine in a front view and in an end view, FIG. 5 shows a plan view and horizontal section of the group turret, FIG. 6 shows a cut-out of a group turret in a modified embodiment, partially in section, FIG. 7 shows a horizontal section through a detail of the group turret according to FIG. 6 in the region of a pushing-out station, FIG. 8 shows a side view of a cut-out of the apparatus with part of the first folding turret and with a second folding turret, FIG. 9 shows a plan view and horizontal section of the detail of FIG. 8, FIG. 10 shows a side view of a detail of the apparatus, in particular in the region of a pack tower following the second folding turret, FIG. 11 shows a plan view and horizontal section of the detail according to FIG. 10, FIG. 12 shows a representation corresponding to that of FIG. 11, with parts of the apparatus in a changed relative position, FIG. 13 shows the detail according to FIGS. 10 to 12 in an end view and in a front view, partially in section, FIG. 14 shows a diagrammatic side view of a detail of an apparatus according to a second exemplary embodiment with a block turret, FIG. 15 shows an end view of the block turret according to FIG. 14, FIG. 16 shows a representation of FIGS. 14 and 15 in the form of a plan view.

The exemplary embodiments and details illustrated in the drawings are devoted to the production of cigarette packs 20, specifically in the soft-pack design. In this pack construction, a cigarette group 21, which in the present case consists of three layers, is first wrapped in an inner blank, in particular in a tin-foil blank 22. This surrounds the cigarette group 21 completely, that is to say by means of end and bottom tabs. An outer blank, in particular a paper blank 23, is made cup-shaped, that is to say only with bottom tabs. The upper region is open, so that a part region of the cigarette group 21 wrapped in the tin-foil blank 22, in particular a tin-foil block 24, projects from the cup-shaped paper blank 23.

According to the exemplary embodiment shown in FIG. 1 ff., the apparatus or packaging machine for producing (cigarette) packs 20 of this type consists of several units.

Individual cigarettes 25 are extracted from a cigarette magazine 26, with cigarette groups 21 being formed. In the region of a pushing-in station 27, the cigarette groups 21 enter a group turret 28 rotating intermittently. The cigarette groups 21 are pushed out of this in the region of a pushing-out station 29 and, via a pushing-in station 30, are pushed into a first folding turret 31 together with a tin-foil blank 22.

In an opposite pushing-out station 32, the partly finished tin-foil blocks 24 enter a linear folding track 33 and, in the region of a further pushing-in station 34, pass from this into a second folding turret 35 with a paper blank 23 provided. The packs 20 leaving the folding turret 35 are ready-folded, in particular with regard to bottom tabs, in the region of a further folding track 36.

A collecting station 37 for the packs, with pack towers 38 and 39 directed upwards, then follows. In the region of these, special banding devices 40,41, which attach (revenue) bands 42 to the end faces of the packs, are used.

The cigarette magazine 26 and the group turret 28 are designed and coordinated with one another in a special way.

The cigarette magazine 26 consists, in a way which is conventional per se, of several cigarette shafts 43 which are intended and designed to receive the cigarettes in close-packed rows 44 resting on top of one another. In these cigarette shafts 43, the cigarettes 25 slide down under their own weight into the region of the pushing-out station. The cigarette shafts 43 are separated from one another by thin shaft walls 45.

Several cigarette shafts 43 are combined to form a particular shaft group 46,47,48,49. The number of cigarette shafts 43 per shaft group 46 to 49 corresponds to the number of cigarettes 25 per cigarette group 21 or the number of cigarettes per layer. In the present exemplary embodiment, the cigarette groups 21 each consist of three layers, the middle layer being offset relative to the outer layers (saddle arrangement).

The individual shaft groups 46 to 49 are divided off from one another by partition walls 50,51,52 (FIGS. 2 and 3). The shaft walls 45 tapering off very thinly are anchored in a lower bottom wall 53 of the shaft group 46 to 49. The particular cigarettes at the bottom or the lower layer of these rest on this bottom wall 53. The shaft groups 46 to 49 are limited laterally and on the end faces by side walls 54 and 55. These are provided in the lower region with orifices, through which rams or ram groups 56,57,58 and 59 (FIGS. 4 and 5) can pass to push out a cigarette group. Each ram group 56 to 59 consists of individual vertical rams, the height of which is such that, in the present case, three cigarettes resting on top of one another are ejected. The individual rams penetrate into the region between the shaft walls 45.

The finger-like projecting rams of the ram groups 56 to 59 are attached to common ram carriers 60 and 61 so as to project on one side. The upper ram groups 56,57 are attached to the upper ram carrier 60 and the lower ram groups 58 and 59 are attached to the lower ram carrier 61. These are moved to and fro simultaneously in the way also described.

By means of the ram groups 56 to 59 which can be moved to and fro, during each joint pushing-in stroke (directional arrows 62,63) a cigarette group 21 is pushed out of the associated shaft group 46 to 49 and pushed into a pocket 64 of the group turret 28. As can be seen, in this way at the same time, in particular by means of one stroke, four pockets 64 succeeding one another in the peripheral direction of the group turret 28 are supplied simultaneously with a cigarette group 21 in the region of the pushing-in station 27.

For this purpose, the group turret 28 is arranged laterally and offset downwards in relation to the cigarette magazine 26. The four particular pockets 64 located in the pushing-in station 27 are in the upper region of the group turret 28, specifically in a position in which they already participate in the downward movement. The upper pocket 64 assigned to the shaft group 46 is in a position following the highest position, whilst the lower pocket 64 assigned to the shaft group 49 has almost reached the horizontal mid-plane of the group turrets 28.

The pockets 64 of rectangular cross-section corresponding to the cross-section of the cigarette group 21 are aligned with their longitudinal extension (the longitudinal direction of the cigarettes 25) parallel to the axis. With their rectangular cross-section, they are arranged in a particular relative position, in such a way that each pocket 64 is directed exactly transversely relative to the lower region of the associated shaft group 46 to 49. In the pushing-out region of the cigarettes 25, the partially arcuate shaft walls 45 are directed perpendicularly relative to the bottom wall 53 and perpendicularly relative to the pocket 64 or its side walls 65 and 66.

For this purpose, the pockets 64 are directed with their longitudinal mid-plane (parallel to the side walls 65,66) at an angle both to the radial plane and to the tangential plane of the group turret 28, in particular in an oblique position. Their shape arises as a result of this relative position, on the one hand, and as a result of the alignment of the shaft groups 46 to 49 relative to the vertical. As is evident, the shaft groups 46 to 49 are arranged in a fan formation with slight angular deviations from the vertical, so that the downward movement of the cigarettes 25 in the cigarette shafts 43 is not disturbed. Only as a result of this special design of the shaft groups 46 to 49, on the one hand, and the relative position of the pockets 64, on the other hand, is it possible to supply four pockets 64 simultaneously from associated shaft groups 46 to 49 of a common cigarette magazine 46 without an intermediate conveyor member.

The cigarettes 25 are pushed into the pockets 64 in their longitudinal direction, specifically with filters 67 possibly present facing the ram groups 56 to 59. In the region of the pushing-out station 29, the cigarettes 25 or cigarette groups 21 are conveyed axially transversely out of the pockets 64 of the group turret 28. For this purpose, it is necessary for the pockets 64 to have a special design. In particular, these are open not only on one axial side (the pushing-in orifice 68), but also on the side located on the outside in the radial direction (the pushing-out orifice 69). The pushing-in orifice 68 and the pushing-out orifice 69 correspond to the full cross-section of the pocket 64.

The pockets 64 are arranged in a turret ring 70 of the group turret 28 in the angular position described. On the side located opposite the pushing-out orifice 69, a smaller (narrower) passage orifice 71 is formed opposite the cross-section of the pocket 64. This is intended for the entry or passage of an ejector slide 72 in the region of the pushing-out station 29. By means of this ejector slide 72 movable to and fro in the horizontal plane, the complete cigarette group 21 is conveyed out of the pocket 64 axially transversely via the pushing-out orifice 69 and, when this movement is continued, pushed into a pocket 73 of the first folding turret 31.

At the same time, the pushing-out station 29 is offset downwards in terms of height relative to the horizontal longitudinal mid-plane of the group turret 28 (drive shaft 74), in such a way that the particular pocket 64 located in the pushing-out station 29 is directed horizontally. As a result, the folding turret 31 is also mounted offset downwards relative to the group turret 28. The ejector slide 72 is provided with a slide head 75, the contour of which corresponds to the contour of the longitudinal side of the cigarette group 21 facing it, so that the three cigarettes located at the edge are grasped jointly by the ejector slide 72 or the slide head 75.

The cigarettes 25 of the cigarette groups 21 are prevented from shifting relative to one another in the pockets 64 and from falling out via the pushing-out orifice 69. In the exemplary embodiment according to FIG. 1 ff., each pocket 64 has assigned to it retaining members attached to the turret ring 70, in particular pivotable retaining fingers 76 and 77. These are respectively mounted above and below and next to the pockets 64. In the swung-back position (in the region of the pushing-in station 27), the retaining fingers 76,77 are located outside the region of the pushing-out orifice 69, as they are also in the region of the pushing-out station 29. In the retaining position, the particular outer cigarettes 25 located at the edge of the cigarette group 21 (the outer layers) are grasped by a retaining finger 76,77. Their ends match the contour of the cigarettes 25.

In the region of the pushing-in station 27, the open side of the pockets 64 is limited by fixed wall rams 78 movable to and fro. These plate-shaped members penetrate in an exact relative position into the pushing-out orifice 69 of the four pockets 64 located in the pushing-in station 27, in such a way that these are limited exactly to the dimensions of the cigarette group 21. Consequently, in this region, the pockets 64 have a continuously closed cross-section. When the group turret 28 is transported further the amount of one indexing stroke, the wall rams 78 are retracted. The co-rotating retaining fingers 76,77 take effect only outside the pushing-in station 27.

The units of the present packaging machine are designed for two-track operation to increase the output. This means that two packs lying next to one another are produced at the same time.

The group turret 28 is also organised for twotrack operation in terms of its design and function. This means, in the first place, that the dimensions of the pockets 64 in the axial direction are such that two cigarette groups 21 are accommodated next to one another in each pocket. As illustrated, the pockets have a design resembling that of a blind hole, with a pushing-in orifice 68 on one side. A cigarette group **21*a* pushed first into the pocket 64 is conveyed up to the end of pocket 64. The second cigarette group 21*b* remains in a position adjacent to the pushing-in orifice 68. In the present exemplary embodiment, the ends of the cigarettes 25 terminate flush with the side face of the group turret 28. Where filter cigarettes are concerned, the cigarette groups 21 are pushed into the pocket 64 with the filter 67** pointing to the rear.

The feeding of the group turret 28 with cigarette groups 21 is coordinated with the operating cycle in a special way. Each time, the group turret 28 moves the amount of a stroke corresponding to the distances between the pockets 64. The number of indexing strokes is, for example, 600 per minute. During a stop, the same number of cigarette groups 21 is pushed into the four pockets 64 in the region of the pushing-in station 27. Cigarette groups **21*a* are pushed into the two pockets 64*a* and 64*b* located at the top or at the rear in the direction of rotation of the group turret 28, up to the end of the pockets 64*a* and 64*b*. The associated rams or ram groups 56 and 57 are of appropriate dimensions and cover a conveying distance up to the above-mentioned end position of the cigarette groups 21*a***.

The pockets **64*c* and 64*d* are filled with cigarette groups 21*b* which are deposited in the entry region of the pockets 64*c*,64*d*, so that the last-mentioned pockets are each filled with two cigarette groups 21*a*, 21*b*** as a result of this pushing-in operation.

After the ram groups 56 to 59 have been retracted, the group turret 28 moves further the amount of one stroke. In the next position, no cigarette groups 21 are pushed into the (four) pockets 64 which are in the pushing-in station 27. On the contrary, after the complete retraction of the ram groups, the cigarettes 25 in the cigarette shafts 43 of the shaft groups 46 to 49 have time to fall down into the lower position. Only after the group turret 28 has moved further again are two empty pockets **64*a* to 64*d* and two pockets already each provided with a cigarette group 21*a* positioned ready to receive in the region of the pushing-in station 27. The pushing-in operation for all (four) pockets 64** can now be repeated.

The cigarette groups **21*a*, 21*b* assume, in the pockets 64, a distance from one another which is coordinated with the further packaging process. In particular, in the region between the group turret 28 and the (first) folding turret 31, a double-width tin-foil blank is supplied transversely relative to the horizontal conveying direction, in the region of a pack track 80 (FIGS. 1, 2, 5 and 6). The blank 22 is severed from a continuous sheet of material 81 by severing knives 82. Here, the pack track 80 acts like a folding mouthpiece because of its limiting walls. As a result of the relative movement of the cigarette group 21 through the pack track 80 into an adjacent pocket 73 of the folding turret 31, the blank 22 is taken up with it, the front region of the cigarette group 21** thereby being wrapped in the form of a U.

The tin-foil blank 22 is provided with laterally projecting folding tabs, in particular upper and lower longitudinal tabs 83,84 and corner tabs 85,86. The longitudinal tabs 84 and corner tabs 86 in the region between the adjacent cigarette groups 21 are first connected to one another, so as to form a blank which is continuous in the transverse direction. Consequently, the distance between the cigarette groups **21*a*, 21*b* in a pocket 64 corresponds to double the width of the longitudinal tabs 84 and corner tabs 86 of the blank. During the further packaging process, the double blank 23 is divided into two single blanks along a longitudinal separating line 87**.

The retaining members for the cigarette groups 21 in the pockets 64 are designed for two-track operation. On each of the two sides of a pocket 64, two pairs of retaining fingers 76,77 (FIGS. 2–5) are arranged on a rotary shaft 88. To-and-fro rotary movements of the latter are controlled by a fixed cam disc 89, in the control groove 90 of which runs a tracer wheel 92 connected to a crank arm 91. As a result of the shape of the control groove 90, the movements of the retaining fingers 76,77 are executed in the way described.

The turret ring 70 gives the group turret 28 open on one side a pot-like shape. Inside this hollow body, two ejector slides 72 located next to one another and movable simultaneously are arranged in the region of the pushing-out station 29. Matching these, each pocket 64 is provided with two slot-like passage orifices 71 located next to one another for the ejector slides 72 in the region of the cigarette groups 21a,21b. These passage orifices 21 of closed cross-section have a slightly smaller height than the corresponding dimension of the pocket 64.

An embodiment of the group turret 28 which is modified where the design of the pockets is concerned is shown in FIGS. 6 and 7. The pockets 64, in terms of the orientation of their longitudinal mid-plane, have the same relative position within the group turret 28 as in the exemplary embodiment described previously. The difference is that the cigarette groups 21 in the pockets 64 are exposed to a lateral pressure to give the cigarette group its proper shape and size.

For this purpose, one of the side walls of the pocket 64 is made movable in order to narrow or widen the pocket 64. In the actual exemplary embodiment, the side wall is part of a pressure lever 93 which is mounted pivotably as a one-armed lever on a pivot bearing 94 within the group turret 28. A radially outer wedge piece 95 forms that side wall of the pocket 64 which is at the front in the direction of rotation.

The pivotable pressure lever 93 and consequently the wedge piece 95 are under elastic pressure acting to reduce the width of the pocket 64. In the present case, a compression spring 96 is assigned to the pressure lever 93 in the region of the wedge piece 95. This compression spring 96 is supported on a likewise movable controllable actuating member, in particular on an actuating lever 105 which is likewise one-armed here. This is likewise mounted pivotably in the region of the pivot bearing 94 and is controlled via a tracer roller 106 by a curved track 107 extending within the group turret 28.

As a result of an appropriate design of the curved track 107, the actuating lever 105 is moved so that the cigarette groups 21 are subjected to pressure by the wedge piece 95 during their transport from the pushing-in station 27 to the pushing-out station 29. The actuating lever 105 is thereby laid against the pressure lever 93, at the same time compressing the compression spring 96.

The actuating lever 105 designed with an appropriate length has a further function, in particular that of retaining the cigarettes or a cigarette located at the corner of the cigarette group 21 facing it, instead of the retaining finger 77 which, in this exemplary embodiment, is lacking on the side of the pressure lever 93. For this purpose, the free end of the actuating lever 105, is provided with a laterally directed nose 108 engaging round the cigarette located at the corner.

In the region of the pushing-out station 29, the actuating lever 105 is swung back into an initial position, thereby relieving the compression spring 96. As a result, the pressure lever 93 with the wedge piece 95 is also lifted off from the cigarette group 21, thereby enlarging the pocket 64 correspondingly. The cigarette group can now be pushed out in the way described.

As is evident from FIG. 7, the pressure lever 93 and the actuating lever 105 extend over the entire length of the pockets 64 designed to receive two cigarette groups 21. At the same time, the pivot bearing 94, like the curved track 107, is located outside the region of the turret ring 70.

When the retaining fingers 76,77 or the actuating lever 105 and the pressure lever 93 are moved into the retracted initial position in the region of the pushing-out station 29, cigarette-holders 97,98 come into operation. These are elongate bar-shaped retaining members which, assigned to each cigarette group 21a, 21b in a pocket 64, enter the pushing-out orifice 69 of the pocket 64 from the sides. For this purpose, the cigarette-holders 97,98 are brought into their position from a lateral position (indicated by dot-and-dash lines in FIG. 5) by being moved transversely and then brought up to the group turret 28 along an arc. A part region of each cigarette-holder 97,98 then rests against the outer face of a cigarette group 21a,21b. The surface turned towards the cigarettes has a profile corresponding to the lateral contour of the cigarette group, so that the latter is supported positively. When the cigarette groups 21a,21b are ejected, the cigarette-holders 98 are moved in the opposite direction and accordingly travel together with the cigarette groups 21a,21b along a particular path of the latter, before they are drawn off laterally. The supporting function of the cigarette-holders 97,98 is thereby maintained beyond the transverse plane predetermined by the blank 22 provided, so that the take-up of the blank 22 by the cigarette group is carried out, during the initial phase, by the cigarette-holders 97,98 which thus protect the cigarettes from being subjected to excessive stress by the blank 22 pulled along with them.

The blank 22 is provided in such a relative position in relation to the pack track 80 that an asymmetric position relative to the cigarette group in the pocket 73 of the turret 31 is obtained. A blank leg 99 of the blank 22 projects from the pocket 73 in the radial direction. During the further movement of the folding turret 31 in the direction of rotation shown, this blank leg 99 is folded round by a fixed outer arcuate guide wall 100 and is placed in a position directed to the rear. When the cigarette group is pushed out of the pocket 73 in the region of the pushing-out station 32, part of the blank leg 99 is folded round into the radially directed plane, in particular to form part of the front or rear side of the inner wrapper.

The pack track 80 and, correspondingly, the pockets 73 of the first folding turret 31 are subdivided in the middle region by a partition wall 101 and by a folding web 102 respectively. As a result, on the one hand exact paths of movement for the cigarette groups are obtained, tilting being avoided. On the other hand, by means of the end faces of the folding web 102, the middle folding tabs, that is to say those located between the cigarette groups 21a,21b, are partially folded, in particular the corner tabs 86. On the outsides, the pocket 73 is provided with corresponding folding webs 103 which fold the outer corner tabs 85 into their position during the time when the cigarette groups 21 together with the blank 22 are pushed into the pocket 73, and which fix them laterally.

After the ejector slide 72 has been retracted into the initial position, the cigarettes in the pocket 73 are held in position on the radially outer side by a further retaining member. This is a supporting plate 104 in the form of a circular arc, which is movable to and fro concentrically relative to the folding turret 31 along the periphery of the latter. FIG. 2 shows the supporting position. When the turret 31 is moved further, the supporting plate 104 is taken with it during a part movement, before it returns to a lower initial position as a result of a concentric rotary movement. This ensures that the still not yet wrapped cigarettes are supported in the pockets 73 over the entire peripheral region of the cigarette group 21.

The cigarette groups 21 partially wrapped in the tin-foil blank 22 are transported by the folding turret 31 up to a pushing-out station 32 located opposite the pushing-in station 30. Here, the two cigarette groups **21*a*,21*b* located next to one another in a pocket 73 are jointly ejected from this, specifically by two interconnected and jointly movable rams 109,110. The cigarette groups, each with an associated (part) blank 22, now enter the folding track 33, where the longitudinal tabs 83 and 84 projecting in the middle region and laterally are folded round into the plane of the end faces by lateral folding members, in particular folding switches 111. As shown in FIG. 8, the lower longitudinal tabs 83, 84 are folded by the folding switches 111. Upper longitudinal tabs are likewise folded into the end face as a result of a subsequent upward movement of the cigarette groups, together with the blank, by means of a lifting ram 112 in relation to a fixed folding member, in particular lateral folding walls 113 and a common central folding wall 114. Accordingly, the folding track 33 consists of two portions offset relative to one another in terms of height. The upper portion at the same time forms the pushing-in station 34 for the following second folding turret 35. The cigarette groups 21 are now wrapped completely in the tin-foil blank 22 and thus form a tin-foil block 24. The two tin-foil blocks 24 now located next to one another are pushed into a pocket 116 of the folding turret 35 in the radial direction by a common pushing-in device 115** movable to and fro.

The folding turret 35 serves for attaching and (partially) folding the outer paper blank 23. In the present case, this is introduced into the pockets 116 before the pushing-in station 34 in the direction of rotation of the turret, specifically in a lower region, as a result of a radially directed upward movement. The paper blanks 23 are severed from a paper sheet 117 in the region of a horizontal feed-conveyor track 118 by knife rollers 119. A plunger 120 movable up and down introduces the paper blank 23 into the pocket 116 open at the bottom, thereby deforming it in the form of a U. The plunger 120 is provided with a suction bore 121 in the end face for fixing the paper blank 23. The pocket 116 is also provided, on its side faces, with suction bores 122 for retaining the paper blank 23 in the pocket 116 without any variation of the U shape. The axial dimensions of the paper blank 23 and consequently of the pockets 116 and the plunger 120 are such that two tin-foil blocks 24 located next to one another at a distance can be processed at the same time.

Accordingly, in the region of the pushing-in station 34, the two tin-foil blocks 24 are pushed into a U-shaped (double-width) paper blank 23 already located in the pocket 116.

Side-folding tabs 123 and 124 of the paper blank 23 which project from the pocket 116 laterally, in particular in the radial direction, are at the same time held in a position widening in the form of a funnel, that is to say diverging. For the lower shorter side-folding tab 123, a guide finger 125 is mounted pivotably below the conveying plane of the tin-foil blocks 24. The guide finger 145 is moved out of a lower initial position (indicated by dot-and-dash lines) into an oblique guide position which makes it easier to introduce the tin-foil blocks 24 and in which the associated side-folding tab 123 is pressed down slightly.

The opposite upper side-folding tab 124 is retained against a fixed guide wall 126 in the form of a circular arc by means of suction bores 127.

After the tin-foil blocks 24 have been pushed into the U-shaped paper blank 23 in the pocket 116, the lower side-folding tab 123 is first folded into the plane of the side face of the pack by a folding web 128 which can be moved upwards in a tangential plane. The folding turret 35 is now moved further the amount of one stroke, the folding web 128 initially being moved with it, until the side-folding tab 123 enters the region of the guide wall 126 and is retained by the latter. Beforehand, as a result of the relative movement, the upper side-folding tab 124 has already been folded round into the plane of the side face of the pack by the guide wall 126.

The side-folding tabs 123,124 are connected to one another by glueing. For this purpose, they are provided with hot-melt markings which are activated by fixed stamps 129 and 130 which can be brought up against the packs in the pockets 116. At the same time, the side-folding tabs 123,124 are connected to one another as a result of the pressure exerted.

In the region of a pushing-out station 131 located opposite the pushing-in station 34, the tin-foil blocks 24 provided with the paper blank 23 are pushed out of the pockets 116 in a horizontal plane and in the radial direction by appropriately designed slides 132 and are pushed into the folding track 36. Here, lower longitudinal tabs still projecting are folded round on one side by folding switches 133 to form the bottom. Upper longitudinal tabs 134 are folded round into the plane of the bottom wall during a new upward movement of the now finished packs 20 into the pack tower 38 or 39.

In the region of the pack towers 38,39 assigned to each track, revenue bands 42 are attached to the packs 20 in the region of the exposed end face of the tin-foil blocks 24. The revenue bands 42 extend transversely over the end face of the pack 20, in such a way that a middle part 135 rests against the end face and legs 136 rest against the front and rear walls.

As is evident from FIGS. 10 to 13, the packs 20 are arranged in the region of the folding track 36 in such a way that the upper end faces 137 to be provided with the revenue band 42 are directed towards the same side in both rows of packs 20. Part tracks 138,139 of the folding track 36 which are located next to one another in the conveying direction, end offset relative to one another. The part track 138 is longer than the part track 139 in the conveying direction. The pack towers 38,39 are thus arranged offset relative to one another. This produces, in the region of the part track 139, a recess 140, in which the revenue-band unit 40 assigned to the pack tower 38 is accommodated. The second revenue-band unit 41 is arranged laterally next to the associated pack tower 39.

Each revenue-band unit 40,41, consists of a transfer wheel 141 as its most important member. Individual revenue bands 42 are each extracted from an associated revenue-band magazine 142 by means of a known rolling-off device 143. The revenue bands 42 are laid on the periphery of the transfer wheel, specifically at intervals and in a predetermined exact relative position.

During the transport of the revenue bands 42 on the transfer wheel 141, the side to be connected to the packs 20 faces outwards. This is provided with glue, specifically by means of a segmental wheel 144, the periphery of which is provided with glue from a glue vessel 146 by a glue roller 145.

To transfer the revenue bands 42 to the packs 20, the transfer wheel 141 is provided with several, in the present case five transfer members, in particular radially movable transfer rams 147. These are fork-shaped, with two lateral supporting legs 148 and 149. Each supporting leg 148,149 is provided with suction bores 150 opening onto the radially outer receiving surface. The supporting legs 148,149 are so arranged at a distance from one another (in the peripheral direction) and the revenue bands 42 are laid on the periphery of the transfer wheel 141 in such a way that the ends of the revenue bands 42 are grasped by the suction bores 150 of the supporting legs 148,149 and are fixed on the transfer wheel 141.

Between the supporting legs 148,149 is located a pressure stamp 151 in the form of a circular arc on the outside. This fills the peripheral gap between the supporting legs 148, 149. The pressure stamp 151 is movable in the radial direction relative to the supporting legs 148,149 and is supported via a compression spring 153 on a radially inner supporting body 152 connecting the supporting legs 148,149 to one another. The supporting body 152 is made wedge-shaped in the radially inner region. A lateral extension 154, of arcuate cross-section, of the supporting body 152 projects from the region of the transfer wheel 141 and serves for supporting an actuating member in the form of a slide 155 with actuating legs 156, 157. The latter bear on the respective extensions 154 of the two transfer wheels 141. The slide 155 is movable to and fro, at the same time taking with it the transfer rams 147 which are both in the transfer position and which belong to the two transfer wheels 141.

In the transfer position, as a result of a radial movement of the transfer ram 147 or of the two supporting legs 148,149, the revenue band 42 is transferred to the pack 20 provided in the corresponding relative position. The middle part 135 thereby comes up against the end face 137 of the packs, whilst the legs 136 are pressed by the supporting legs 148,149 against the front and rear sides of the pack. For this purpose, the supporting legs 148, 149 are at a distance from one another which corresponds approximately to the width of the pack 20, so that the supporting legs 148,149 are moved along the front and rear sides of the pack 20 as a result of the radial movement of the transfer ram 147, thereby pressing down the legs 136 of the revenue band 42.

As a result of the above-described movement of the transfer ram 147, the revenue band 42 is also pressed against the end face 137 in the region of the middle part 135 because of the tension in the longitudinal direction. The compression spring 135 is thereby compressed (FIG. 12). When the slide 155 returns into the initial position (indicated by dot-and-dash lines in FIG. 12), as a result of the relaxation of the compression spring 153 the transfer ram 147, together with the supporting legs 148,149, is moved back into the initial position. The compression spring 153 is thereby supported on the supporting body 152 extending in the peripheral plane of the transfer wheel 141.

The revenue bands 42 are transferred to the particular pack 20 provided for this, in the plane of the folding track 36 or of the part tracks 138,139. A lifting stamp 158 acts to limit the bottom of each of the part tracks 138,139 in this region (pack tower 38,39). Its stamp plate 159 is provided with a cut-out 160 on the side facing the transfer wheel 141. The transfer ram 141 or the lower supporting leg 149 penetrates into this cutout 160 during the transfer of the revenue band 42. After the supporting legs 148,149 have been retracted, the now completed pack 20 is lifted by the lifting stamp 158, specifically up to the bottom of a pack stack 161 already formed. This is carried by supporting webs 162, 163 which each grasp the lower pack 20. The supporting webs 162, 163 are movable transversely relative to the pack tower 38,39, in particular out of the region of the pack stack 161, so that the lower pack can be delivered to the pack stack 161. By means of the cut-out 160 in the stamp plate 159 and by means of a further opposite cut-out 164, after a (lower) pack has been delivered to the pack stack 161, the supporting webs 162,163 can grasp the latter on the under side, before the lifting stamp 158 is moved downwards back into the initial position.

The upper packs 20, specifically in groups each consisting of two packs resting on top of one another, are conveyed out of the pack tower 138,139 by cross slides 165 into a horizontal pack conveyor 166.

An alternative solution for forming tin-foil blocks 24 and introducing them into the further packaging process is illustrated in FIGS. 14 to 16.

In this method, tin-foil blocks 24 produced somewhere else are supplied in pairs in two parallel tracks by block conveyors 167 and 168. In the region of these block conveyors 167, 168, the tin-foil blocks 24 are transported in a horizontal plane and at a distance from one another by suitable conveyor members, for example chain conveyors.

Assigned to each block conveyor 167, 168 is a transfer turret 169,170. These are arranged with their axes of rotation (shaft 171) in the conveying direction of the tin-foil blocks 24. Consequently, the transfer turrets 169,170 rotate in planes transverse relative to the block conveyors 167,168, specifically in the direction of rotation indicated by arrows 172.

The transfer turrets 169,170 serve for transferring the tin-foil blocks 24 from the block conveyors 167,168 to a common block turret 173. This is designed in a similar way to the group turret 28 of the exemplary embodiment described above. In a similar way, pockets 174 are arranged along the periphery of the block turret 173 in an oblique position, in particular at an angle between the tangential and the radial relative to the mid-plane. The tin-foil blocks 24 are introduced into the pockets 174 in the axial direction via lateral pushing-in orifices 175. In a similar way to the group turret 28, the design and dimensions of these in the axial direction are such that two tin-foil blocks **24*a* and 24*b* are accommodated next to one another in a pocket 174**, specifically at a distance from one another.

The transfer turrets 169,170 are designed and arranged in such a way that, during a stop phase, each can simultaneously receive one tin-foil block 24 and transfer one tin-foil block to the block turret 173. For this purpose, the transfer turrets 169,170 are provided with pockets 176,177 which are temporarily made to coincide with one block conveyor 167,168 or the other and with a particular pocket 174 of the block turret 173.

The transfer turrets 169,170 are of differing size, in particular have different diameters. The smaller transfer turret 169 assigned to the block conveyor 167 is provided with three pockets 176 which, parallel to the tangential and at a distance from it, are designed as a chamber closed in the peripheral direction or as a channel of closed cross-section, open at both ends. Accordingly, the three pockets 176 are arranged at the same angles relative to one another and at the same distances from one another.

In a specific position of the transfer turret 169 (FIG. 14), a lower horizontally directed pocket 176 is in the path of movement of the block conveyor 167, so that a tin-foil block 24 can be pushed into the lower pocket 176 as a result of appropriate conveyance. A further pocket 176 of the transfer turret 169 coincides with a pocket 174 of the block turret 173, so that, likewise as a result of axial movement, the pack or the tin-foil block 24 can be transferred from the pocket 176 to the pocket 174. For this purpose, the transfer turret 169 is shifted slightly in the direction of rotation of the block conveyor 173 out of its vertical mid-plane.

The second transfer turret 170 is located on the other side of the vertical mid-plane of the block turret 173 at a greater distance from this mid-plane. The four pockets 177 arranged at right angles to and parallel to one another respectively are likewise coordinated with the block conveyor 168 and with a particular pocket or a specific relative position of a pocket 174 of the block turret 173. As illustrated, a lower horizontally arranged pocket 177 is in the path of movement of the tin-foil blocks 24 of the block conveyor 168 so that the tin-foil block 24 is introduced into the pocket 177 as a result of axial conveyance. The vertically directed pocket 177 following next in the direction of rotation coincides with a pocket 174 arranged in this position in the block turret 173. Accordingly, here again, the tin-foil block 24 can be transferred to the block turret 173 as a result of renewed axial displacement.

For the (simultaneous) transfer of a tin-foil block 24 from each of the transfer turrets 169,170 to the block turret 173, there are rams 183, 184 which are assigned to the two transfer turrets 169,170 or to the pockets 176,177 each located opposite a pocket 174 of the block turret 173.

Again in the present exemplary embodiment, the tin-foil blocks **24*a*, 24*b* are pushed into a pocket 174 of the block turret 173 in successive working strokes. Because of the arrangement and design of the transfer turrets 169,170, one pocket 174 always remains free between the particular filling positions. Accordingly, whilst the block turret 173 is driven at the maximum stroke rate (for example, 600 indexing strokes per minute), a tin-foil block 24 is pushed in only during every second indexing stroke or whenever the block turret 173 stops, specifically first in the region of the larger transfer turret 170, the tin-foil block 24*a* to be moved up to the inner end of the pocket 174, and then in the region of the transfer turret 169 the second tin-foil block 24*b* facing the pushing-in orifice 175**. Consequently, even here, the pushing-in movements are slower and do not damage the cigarettes.

The tin-foil blocks 24 introduced into the pockets 174 in the axial direction are pushed out of the pocket 174 in the region of a pushing-out station 178 in the axial direction or approximately axial direction, but at all events axially transversely relative to the cigarettes, and are pushed into a pocket 179 of a folding turret 180. For this purpose, there is a double slide 181 which is movable to and fro within the block turret 173 and which penetrates into the pocket 174 in the region of the tin-foil blocks **24*a*, 24*b* via an inner pushing-out orifice 182. During the movement to transfer the tin-foil blocks 24*a*, 24*b* into the folding turret 180, a paper blank 23 provided in a transverse plane is taken up, thereby being folded round the two tin-foil blocks 24*a*, 24*b* in the form of a U. The further folding cycle for this (double) paper blank 23** corresponds to that of the exemplary embodiment already described.

We claim:

1. In a process for packaging cigarettes by combining them into cigarette groups and wrapping them in a blank of packaging material, wherein a group is conveyed and introduced into a pack pocket of a folding turret, taking with it the blank provided in a plane transverse relative to the conveying direction of the group, and the group is conveyed further, the blank is folded, and wherein the folding turret (31) is preceded by a group turret (28) which conveys the cigarette groups (21) into the group pockets (64), the articles being pushed into a pocket (64) in the direction of the longitudinal axis of the cigarettes and parallel to the rotational axis of the group turret (28), and being pushed out in an axially transverse direction, the improvement comprising the steps of: conveying cigarette groups (21) in group pairs **(21*a*, 21*b*) in two tracks located next to one another; providing the pockets (64) with an axial length which is greater than twice the longitudinal length of the cigarettes; and, in the region of a pushing-in station (27), pushing two cigarette groups (21*a*, 21*b*) in succession into a common pocket (64) in such a way that the cigarette groups (21*a*, 21*b*) are arranged inside the pocket (64) at a distance from one another in the axial direction, wherein a first cigarette group (21*a*), distant from an inlet side pushing-in orifice (68) of the pocket, is pushed into the pocket (64) in a first pushing-in stroke, and the second cigarette group (21*b*) adjacent the pushing-in orifice (68) is pushed into the pocket (64)** in a second pushing-in stroke.

2. Process according to claim 1, further comprising, wherein the cigarettes are filter cigarettes, locating the filters (67) of the cigarette group **(21*a*, 21*b*) in the common pocket (64) of the group turret (28) to face the inlet side pushing-in orifice (68) of the pocket (64)**.

3. Process according to claim 1, wherein the group turret (28) is rotationally indexed so that four pockets (64) of the group turret (28) are simultaneously positioned for receiving cigarette groups, and further comprising the steps of, in two pockets **(64*a*, 64*b*) of the four pockets, pushing the first cigarette groups (21*a*) into the inner position axially distant from the pushing-in orifice (68), and at the same time, in two further pockets (64*c*, 64*d*), pushing the second cigarette groups (21*b*) into the outer position axially adjacent the pushing-in orifice (68)**.

4. Process according to claim 1 or 3, further comprising pushing cigarette groups (21) into pockets (64) of the group turret (28) every other second indexing stroke of the latter.

5. Apparatus for packaging cigarettes combined into cigarette groups, by wrapping them in at least one blank of packaging material, and including a folding turret, a group turret, a pushing-in station, a pushing-out station and mans for conveying and introducing a cigarette group into a pack pocket of the folding turret, taking with it the blank provided in a plane transverse relative to the conveying direction, and during its further movement the blank being folded, said apparatus comprising means for combining the cigarettes (25) into individual cigarette groups (21) in group pockets (64) in the region of the group turret (28) preceding the folding turret (31) in the conveying direction, means for pushing the cigarettes (25), in the region of the pushing-in station (27), into several pockets (64) simultaneously in the longitudinal axis direction of the cigarettes and, means, in the region of the pushing-out station (29), for pushing cigarette groups out of one of the pockets in the axially transverse direction, the pockets having, in a direction parallel to the rotational axis of the group turret (28), an axial length greater than twice the longitudinal length of a cigarette group so that each pocket can receive in the axial direction two cigarette groups (21*a*, 21*b*) located next to one another; and means for, during each pushing-in stroke, pushing two cigarette groups (21*a*), to be distant from a pushing-in orifice (68) of the pockets (64), into two first pockets (64*a*, 64*b*) located at the rear in the conveying direction, and pushing two different cigarette groups (21*b*), to be adjacent the pushing-in orifice (68), into two different pockets (64*c*, 64*d*) located at the front in the conveying direction.

6. Apparatus according to claim 5, characterised in that the pockets (64) of the group turret (28) are open on the radially outer side and are provided with movable retaining members in the region of a radially directed pushing-out (69) of the pockets (64), in the form of pivotable retaining fingers (76, 77) located opposite one another, for grasping at least the outer cigarettes (25) of the cigarette group (21) which are located at the edge, the retaining fingers (76, 77) being moved out of engagement with the cigarettes (25) in the region of the pushing-in station (27) and of the pushing-out station (29).

7. Apparatus according to claim 6, characterised in that, in the region of the pushing-in station (27), the pockets (64) of the group turret (28) have assigned to them, to limit the radially outer open side of pushing-out orifices (69), locally fixed side-wall rams (78) movable to and fro, and that there are means which, during the time when the cigarettes (25) are pushed into the pockets (64), are moved into a closing position for limiting the orifices (69) laterally.

8. Apparatus according to claim 5, further comprising a cigarette magazine having cigarette shafts carrying cigarettes, and characterised in that, to form cigarette groups (21) in the pocket (64) of the group turret (28), in the region of the pushing-in station (27), there are provided means for pushing the cigarettes (25) directly out of lower pushing-out regions of the cigarette shafts (43) of the cigarette magazine (26), and in that the cigarette shafts (43), separated from one another by shaft walls (45), of a shaft group (46, 47, 48, 49) are assigned to a particular pocket (64) extend essentially vertically, but at an angle relative to one another, so that four shaft groups (46 to 49) are arranged in a fan-like formation and are assigned to a corresponding number of pockets (64*a*, 64*b*, 64*c*, 64*d*) of the group turret (28).

9. Apparatus according to claim 8, characterised in that the pockets (64) are directed with a transverse mid-plane at an angle both to the radial plane and to the tangential plane of the group turret (28) and a in the pushing-in station (27), are transverse relative to the lower regions of the cigarette shafts (43).

10. Apparatus according to claim 9, characterised in that the pushing-out station (29) or the pushing-out plane for the cigarette groups (21) is offset downwards in the region of the latter relative to a horizontal mid-plane of the group turret (28), in such a way that particular pockets (64) located in the region of the pushing-out station (29) are directed horizontally.

11. Apparatus according to claim 8, characterised in that the four pockets (64*a*, 64*b*, 64*c*, 64*d*) are arranged offset relative to one another in terms of height in the region of the pushing-in station (27), in an upper position moved out of the vertical mid-plane of the group turret (28), and the lower ends of the shaft groups (46,47,48,49) correspondingly terminate offset in terms of height and laterally in the region of the associated pockets (64).

12. Apparatus according to claim 8, characterised in that four cigarette groups (21) are pushed simultaneously out of a corresponding number of shaft groups (46 to 49) and into the same number of pockets (64*a*, 64*b*, 64*c*, 64*d*) of the group turret (28).

13. Apparatus according to claim 5, characterised in that the group turret (28) each time can be moved the amount of a division predetermined by the pockets (64), and after every second indexing stroke cigarette groups (28) can be pushed into the four pockets (64) in the pushing-in station (27).

14. Apparatus according to claim 5, characterised in that the two cigarette groups (21*a*, 21*b*) are pushed from the pocket (64) simultaneously, and, by taking up a double-width blank (22) provided transversely relative to the direction of ejection, are wrapped in this in the form of a U, and the axial distance between the cigarette group (21*a*, 21*b*) in the pocket (64) corresponds to the width of a strip of material within the blank (22) which, after the latter is severed, serves to form end tabs (longitudinal tabs (83, 84) and corner tabs (85, 86) of the blank (22)).

15. Apparatus according to claim 5, comprising an ejector slide (72), displaceable in a horizontal plane at a distance below the axis bf rotation of the group turret (28), penetrating into the pocket (64) of the group turret (28) via an inner passage orifice (71) and resting against the cigarette group (21) by means of a slide head (75) having the contour of the side face of the cigarette group (21) facing it.

16. Apparatus according to claim 6, characterised in that, after the retaining fingers (76,77) at the pockets (64) have been retracted in the region of the pushing-out station (29), the cigarette groups (21*a*, 21*b*) are fixed by means of cigarette-holders (97,98) penetrating via the pushing-in orifice (68), and when the cigarette groups (21*a*, 21*b*) are pushed out of the pocket (64) the cigarette-holders (97,98) are moved together with these, whilst continuing to rest against the front side face of the cigarette groups (21*a*, 21*b*), along a path, in particular beyond the vertical conveying plane of the blank 22), in such a way that the latter first wraps itself round the cigarette-holders (97,98) in the form of a U.

17. Apparatus according to claim 16, characterised in that a separate cigarette-holder (97, 98) which is mounted laterally next to the group turret (28) and which is driven jointly is assigned to each cigarette group 21*a*, 21*b*) within a pocket (64), and comprising means for moving the cigarette-holders (97, 98) laterally out of the path of movement of the cigarette groups (21*a*, 21*b*) transversely relative to the conveying direction of the latter.

18. Apparatus according to claim 16, characterised in that the bar-like or finger-like cigarette-holders (97,98) are designed, on the side facing the cigarette group (21*a*, 21*b*), with a contour corresponding to that of the side face of the latter.

19. Apparatus according to claim 5, characterised in that the cigarette groups (21) can be compressed elastically in the pockets (64) of the group turret (28) by means of a resilient mounting of a side wall of the pockets (64).

20. Apparatus according to claim 19, characterised in that a side wall of the pockets (64) is mounted pivotably, as part of a pressure lever (93), and is stressed elastically by a compression spring (96), and the pressure lever (93) is loaded by an actuating lever (125) via the compression spring (96) so as to compress the cigarette group (21) and is controlled, by means of a curved track (107) with a tracer roller (106), in such a way that in the region of the pushing-in station (27) and the pushing-out station (28) the side wall or the pressure lever (93) is relieved.

21. Apparatus according to claim 20, characterised in that the actuating lever (105) has, at its radially outer end, a projecting nose (108) for grasping and securing the outer cigarette of the cigarette group (21).

22. Apparatus according to claim 15, characterised in that, after the ejector slide (72) has been retracted, the cigarette groups (21) in the pocket (73) of the (first) folding turret (31) are fixed on the radially outer side by a movable retaining member, in particular by a supporting plate (104) curved in the form of a circular arc and pivotable to and fro in the peripheral direction of the folding turret (31).

23. Apparatus according to claim 5, characterised in that, when the cigarette group (21) is pushed into the folding turret (31), the blank (22) is arranged offset in relation to the cigarette group (21), in such a way that a blank leg (99) projecting in the radial direction projects radially from a pocket (73) of the folding turret (31) and subsequently is folded round the side face and part of the front or rear side of the cigarette group.

24. Apparatus according to claim 23, characterised in that, as a result of the further movement of the folding turret (31), the blank leg (99) is folded partially and, when the cigarette group is pushed out of the folding turret (31), is folded completely.

25. Apparatus according to claim 5, characterised in that a pack track (80) located between the group turret (28) and the folding turret (31), pockets (73) of the folding turret (31) and a folding track (33) adjoining the latter are divided centrally to receive the two cigarette groups (21*a*, 21*b*), and in the region of the folding turret (31) and the folding track (33) are arranged folding members, for folding end tabs (86) formed centrally between the cigarette groups (21*a*, 21*b*), and lateral limitations (102, 103) for folding outer corner tabs (85).

26. Apparatus according to claim 25, characterised in that, in the region of a folding track (31) adjoining the folding turret (31), upper end tabs (83,84) are folded as a result of an upward movement of the cigarette group (21) and by means of fixed folding members.

27. Apparatus according to claim 25, comprising means for pushing tin-foil blocks (24) formed in the folding turret (31) or in the folding track (33) into a further folding turret (35) in a pushing-in station (34) offset in terms of height, at the same time being partially wrapped in a further blank (paper blank 23).

28. Apparatus according to claim 27, characterised in that, for wrapping two tin-foil blocks (24) lying next to one another in a pocket (116), the further folding turret is supplied with two paper blanks (23) located next to one another and separated from one another, for wrapping one tin-foil block each.

29. Apparatus according to claim 28, characterised in that the two paper blanks (23) can be introduced into the open pockets (116), in the region of a lower feed station of the folding turret (35), as a result of the upward movement of the plunger (120), thereby being deformed in the form of a U, and are fixed in these pockets (116), in the U-shaped position by means of suction bores (122), side-folding tabs (123, 124) projecting from the pocket (116) in the radial direction.

30. Apparatus according to claim 29, characterised in that, in the pushing-in station (34), the side-folding tabs (123, 124) projecting from the pocket (116) are fixed in a diverging position opening in the manner of a mouthpiece, in particular by a movable guide finger (125) for the lower side-folding tab (123) and by suction bores (127) of the fixed guide wall (126) for the upper side-folding tab (124).

31. Apparatus according to claim 28, characterised in that the individual paper blanks (23) located next to one another in each pocket (116) of the folding turret (35) are directed towards one and the same side in the axial direction of the folding turret (35) with (bottom) folding tabs (longitudinal tabs 134), and the folding tabs can be folded respectively by folding members (folding switches 133) formed in the region of a folding track (36) and as a result of an upward movement in a pack tower (38, 39).

32. Apparatus according to claim 5, characterised in that a revenue band (42) can be attached, in the region of the lateral end face, to the packs (20) wrapped in the paper blank (32), before they are pushed into the pack tower (38,39), a separate revenue-band unit (40, 41) being assigned to each pack in a pocket (116) of the folding turret and the two revenue-band units (40,41) working in synchronism.

33. Apparatus according to claim 32, characterised in that, in the region of the pack tower (38,39), the revenue-band unit (40,41) is attached laterally next to the latter, the pack towers (38,39) being offset relative to one another in the conveying direction of the packs (20), in such a way that the revenue-band units (40,41) can be located directly opposite the free end faces of the associated packs (20);

34. Apparatus according to claim 32, characterised in that each revenue-band unit (40,41) consists of a transfer wheel (141) receiving the revenue bands (42) along the periphery, with revenue-band transfer members.

35. Apparatus according to claim 34, characterised in that the revenue bands (42), during their transport by the transfer wheel (141), can be coated with glue on the outside, in particular by means of an axis-parallel segmental wheel (144).

36. Apparatus according to claim 34, characterised in that the revenue bands (42) are fixed on the periphery of the transfer wheel (141) at their ends by means of suction bores (150) and can be transferred to the pack (20) in the region of a transfer station by means of radially movable transfer members (transfer rams 147).

37. Apparatus according to claim 36, characterised in that the transfer rams (141) are made U-shaped, with supporting legs (148,149) which have suction bores (150) grasping the ends of the revenue bands (42) and are at a distance from one another corresponding to the width of the pack (20), and which, pressing the revenue band (42) against the front and rear sides of the pack (20), extend on both sides of the latter in the transfer position.

38. Apparatus according to claim 37, characterised in that the transfer rams (147) are stressed elastically into the initial position, in particular by a compression spring (153), and in that the radially directed transfer movement for both revenue-band units (40,41) is executed by means of a common actuating member (slide 155) movable to and fro.

39. Apparatus according to claim 32, characterised in that, for attaching the revenue bands (42), the packs (20) rest on a stamp plate (159) of a lifting stamp (158) of the pack towers (38,39).

40. Apparatus according to claim 5, characterised in that articles, particularly cigarette groups (21), (produced somewhere else) wrapped in a first blank (tin-foil blank 22) can be delivered as tin-foil blocks (24) on a (straight) feed-conveyor track by means of two block conveyors (167,168) for two tin-foil blocks (24) supplied simultaneously, are received by transfer conveyors (transfer turrets 169,170) and can be supplied to an intermediate conveyor (block turret 173), from which the tin-foil blocks (24) can be transferred to a folding turret (180) in the region of a pushing-out station (178), at the same time being wrapped in a (paper) blank (23) in the form of a U.

41. Apparatus according to claim 40, characterised in that the transfer turrets (169,170) are each assigned to a block conveyor (167.,168) with receptacles (pockets 176,177) pointed in the conveying direction of the tin-foil blocks (24), and each time tin-foil blocks (24) can be introduced simultaneously into respective pockets (176, 177) extending in a horizontal plane in the transfer turrets (169,170).

42. Apparatus according to claim 40 or 41, characterised in that the block conveyors (167,168) and the associated transfer turrets (169,170) are arranged offcentre relative to the block turret (173), and in that the transfer turrets (169,170) have different diameters and a differing number of pockets (176,177), and the (smaller) transfer turret (169) located nearest a vertical mid-plane of the block turret (173) has three pockets (176) and the second transfer turret (170) has four pockets (177).

43. Apparatus according to claim 40, characterised in that the articles (tin-foil blocks 24) can be pushed simultaneously out of the pockets (176,177) of the transfer turrets (169, 170) in the axial direction of the latter and can be pushed into coincidentally directed pockets (174) of the block turret (173).

44. Apparatus according to claim 40, characterised in that the pockets (174) in the block turret (173) are directed obliquely, in particular at an angle both to the radial plane and to the tangential plane, in such a way that, during a phase when the block turret and the transfer turrets (169,170) are stopped, two particular pockets (174) of the block turret (173) are directed so as to coincide with pockets (176,177) of the transfer turrets (169,170).

45. Apparatus according to claim 44, characterised in that the channel-shaped pockets (176) of closed cross-section in the transfer turret (169) are at equal acute angles to one another, and the pockets (177) of the transfer turret (170) are arranged respectively at 90° and parallel to one another.

* * * * *